US009293894B2

(12) United States Patent
Suzuki et al.

(10) Patent No.: US 9,293,894 B2
(45) Date of Patent: Mar. 22, 2016

(54) ELECTRIC CHARGE GENERATING DEVICE

(71) Applicant: SMC KABUSHIKI KAISHA, Chiyoda-ku (JP)

(72) Inventors: Satoshi Suzuki, Moriya (JP); Masayuki Orihara, Kuki (JP)

(73) Assignee: SMC KABUSHIKI KAISHA, Chiyoda-ku (JP)

( * ) Notice: Subject to any disclaimer, the term of this patent is extended or adjusted under 35 U.S.C. 154(b) by 244 days.

(21) Appl. No.: 13/788,238

(22) Filed: Mar. 7, 2013

(65) Prior Publication Data

US 2013/0258543 A1 Oct. 3, 2013

(30) Foreign Application Priority Data

Mar. 30, 2012 (JP) ..... 2012-082674

(51) Int. Cl.
*H01T 23/00* (2006.01)

(52) U.S. Cl.
CPC ..... *H01T 23/00* (2013.01)

(58) Field of Classification Search
CPC ..... H01T 23/00
USPC ..... 361/213, 231
See application file for complete search history.

(56) References Cited

U.S. PATENT DOCUMENTS

| | | | | |
|---|---|---|---|---|
| 2,879,395 | A | 3/1959 | Walkup | |
| 6,693,788 | B1 | 2/2004 | Partridge | |
| 7,586,731 | B2 * | 9/2009 | Sato et al. | 361/231 |
| 2005/0174718 | A1 * | 8/2005 | Fujita et al. | 361/220 |
| 2010/0073842 | A1 * | 3/2010 | Fujiwara et al. | 361/220 |

FOREIGN PATENT DOCUMENTS

| | | |
|---|---|---|
| GB | 822555 | 10/1959 |
| GB | 2 313 491 A | 11/1997 |
| JP | 04-163898 | 6/1992 |
| JP | 10-012395 | 1/1998 |
| JP | 10-64659 | 3/1998 |
| JP | 2006-210159 | 8/2006 |
| JP | 2008-288072 | 11/2008 |
| JP | 2009-026716 | 2/2009 |
| WO | 81/03387 | 11/1981 |
| WO | 2007/122742 A1 | 11/2007 |

OTHER PUBLICATIONS

Office Action mailed Nov. 24, 2015, in Japanese Patent Application No. 2012-082674.

* cited by examiner

*Primary Examiner* — Stephen W Jackson
*Assistant Examiner* — Ann Hoang
(74) *Attorney, Agent, or Firm* — Oblon, McClelland, Maier & Neustadt, L.L.P.

(57) ABSTRACT

An ionizer that acts as an electric charge generating device includes a first high voltage power source and a second high voltage power source, which are disposed in confronting relation to each other, and a first wiring arrangement and a second wiring arrangement, which are disposed in confronting relation to each other. The first high voltage power source applies an AC high voltage to needle electrodes via the first wiring arrangement, whereas the second high voltage power source applies an AC high voltage, which is 180° out of phase with the aforementioned AC high voltage, to needle electrodes via the second wiring arrangement.

10 Claims, 18 Drawing Sheets

ELECTRIC CHARGE GENERATING DEVICE

CROSS-REFERENCE TO RELATED APPLICATION

This application is based upon and claims the benefit of priority from Japanese Patent Application No. 2012-082674 filed on Mar. 30, 2012, the contents of which are incorporated herein by reference.

BACKGROUND OF THE INVENTION

1. Field of the Invention

The present invention relates to an electric charge generating device for generating ions, and more specifically, relates to an electric charge generating device that operates favorably as an ionizer for neutralizing static charge on a charged object and removing static charge from the object by releasing ions toward the object as a target object to be neutralized.

2. Description of the Related Art

Known types of ionizers for neutralizing charge and removing static charge from a charged target object to be neutralized by releasing ions toward the target object are disclosed in U.S. Pat. No. 6,693,788 and International Publication No. WO 2007/122742, for example.

In an ionizer disclosed in U.S. Pat. No. 6,693,788, an AC voltage is applied to needle electrodes so as to generate positive ions and negative ions alternately near the needle electrodes, and then the generated positive and negative ions are alternately released toward a target object so as to neutralize the target object.

Further, in another ionizer disclosed in U.S. Pat. No. 6,693,788, and still another ionizer disclosed in International Publication No. WO 2007/122742, one AC voltage is applied to one needle electrode, while another AC voltage that has a polarity different from the one AC voltage is applied to another needle electrode, whereby positive ions and negative ions are simultaneously generated near the needle electrodes, and then the generated positive and negative ions are released toward a target object so as to neutralize the target object.

SUMMARY OF THE INVENTION

Incidentally, in an ionizer, an AC voltage of a comparatively high voltage level (AC high voltage) is applied to needle electrodes for generating positive ions and negative ions. In this case, in the ionizer, positive ions and negative ions are distributed uniformly by adjusting the ion balance in a space (charge removal space) in which charge removal is carried out, and neutralization or removal of static charge on the target object is performed by causing the positive ions and the negative ions to reach the surface of the target object.

However, when positive ions and negative ions are generated alternately in a pulsed manner, and the positive ions and the negative ions are made to reach the target object alternately, the potential amplitude at the target object becomes large due to the arrival periods of the positive ions and the negative ions on the target object. Further, charge induced on the target object (hereinafter referred to as induced charge), which is caused by the power source that applies the AC high voltage to the needle electrodes, or by the wires that electrically connect the power source and the needle electrodes, becomes a source of noise at the object, and in this case as well, the potential amplitude at the target object increases.

To suppress an increase in potential amplitude, up till now, for ensuring a small potential amplitude, the following countermeasures (a) through (c) have been considered.

(a) To devise ways of generating positive ions and negative ions. (b) To suppress induced charge and noise itself. (c) To decrease the potential amplitude or to render the influence of noise due to induced charge relatively small by adjusting the generation periods of positive ions and negative ions so as to make the arrival periods of the positive ions and the negative ions short.

More specifically, the following countermeasures (1) through (6) have been considered.

(1) To separate insofar as possible the distance between the target object and the ionizer. (2) To construct the ionizer and the power source separately, and to separate insofar as possible the distance between the target object and the power source. (3) To increase the frequency of the AC high voltage. (4) To shield the power source and wires in the interior of the ionizer. (5) To apply a positive DC high voltage to one of the electrodes, while applying a negative DC high voltage to the other of the electrodes. (6) To simultaneously generate ions of different polarities in the vicinity of a location where positive ions or negative ions are generated.

However, with the foregoing countermeasures (1) through (6), the following problems have occurred.

With countermeasure (1), since the distance between the target object and the ionizer is increased, the quantity of positive ions and negative ions that reach the target object is reduced. As a result, removal of static charge from the target object takes considerable time, the charge removal speed is reduced, and the charge removal capability of the ionizer decreases.

Thus, it has been considered to place the ionizer and the target object in closer proximity so that positive ions and negative ions are reliably made to reach the target object. However, in this case, since the power source and the wires, which are associated with the ionizer, also are brought into the vicinity of the target object, it is easy for induced charge and noise to be produced, and a reduction in potential amplitude cannot be achieved. Consequently, it is impossible to reduce the distance between the ionizer and the target object.

With countermeasure (2), since the power source and the wires are maintained outside of the ionizer, it is necessary to devise some type of routing or the like for the wires, and a separate countermeasure must be taken for protecting the user from the AC high voltage. As a result, handling of the ionizer is problematic and restrictions related to usage thereof tend to occur.

With countermeasure (3), the times at which the positive portion and the negative portion of the AC voltage are applied to the needle electrodes are shortened respectively. As a consequence, the generation periods for positive ions and negative ions become short, the arrival periods of the positive ions and the negative ions become short, and the potential amplitude becomes small. For these reasons, conversely, the generated quantity of positive ions and negative ions decreases. Consequently, the charge removal speed is reduced, and the charge removal capability of the ionizer decreases.

With countermeasure (4), the generated positive ions and negative ions are absorbed by the shield, so that the quantity of positive ions and negative ions reaching the target object is decreased. In this case as well, the charge removal speed is reduced, and the charge removal capability of the ionizer is lowered.

With countermeasure (5), positive ions are generated in the vicinity of one of the needle electrodes, whereas negative ions are generated in the vicinity of another of the needle electrodes. For this reason, at a region existing between the one needle electrode and the other needle electrode in the charge removal space, both positive ions and negative ions can be made to reach the target object within the same time band. As a result, the positive ions and the negative ions become mixed and ion balance is achieved, while the potential amplitude also can be made small. However, at regions (i.e., at ends of the charge removal space) where there exist only positive ions or negative ions, only one type of such ions can reach the target object. Thus, ion balance cannot be obtained, and the potential amplitude increases. As a result, the region where removal of static charge from the target object can actually be performed tends to be limited.

With countermeasure (6), other needle electrodes are prepared for the purpose of generating ions of different polarity, and it is necessary to apply an AC high voltage to the other needle electrodes. More specifically, it is necessary to prepare another power source for applying an AC high voltage to the other needle electrodes, and another wire connected electrically between the other needle electrodes and the other power source. In this case, induced charge is generated due to the other power source and the other wires, and the potential amplitude becomes large together with noise due to the induced charge.

In this manner, with such a conventional ionizer, induced charge at the target object is generated due to the power source for applying AC voltage to the electrodes, or by wires interconnecting the power source and the electrodes, and as a result of noise from the induced charge, the actual value of the potential amplitude at the target object becomes greater. Further, it is difficult to effectively exclude the presence of such noise and induced charge.

In the foregoing explanations, cases have been described in which the electric charge generating device is an ionizer, however, with an electrifying device as well, which acts as an electric charge generating device for charging a target object by release of ions toward the object, since ions are generated due to application of high voltage with respect to needle electrodes, similar problems can be assumed to occur.

The present invention has the object of resolving the aforementioned problems, and of providing an electric charge generating device in which induced charge generated at a target object caused by power sources and wires, and the influence of noise due to such induced charge can be eliminated.

An electric charge generating device according to the present invention comprises at least two electrodes, a first power source for applying a first voltage to one first electrode, a second power source for applying a second voltage of different polarity than the first voltage to another second electrode, a first wiring arrangement electrically connecting the first power source and the first electrode, and a second wiring arrangement electrically connecting the second power source and the second electrode.

In this case, if the first voltage is applied from the first power source to the first electrode via the first wiring arrangement, and the second voltage is applied from the second power source to the second electrode via the second wiring arrangement, ions are generated in the vicinity of the first electrode, and ions, which differ in polarity from the aforementioned ions, are generated in the vicinity of the second electrode.

For this reason, assuming that the electric charge generating device is an ionizer, by releasing generated ions toward a target object, the charged target object can be neutralized and static charge can be removed from the target object. On the other hand, if the electric charge generating device is a charging device, by releasing generated ions toward a target object, the target object can be charged.

Incidentally, as noted previously, with the conventional electric charge generating device, an induced charge is generated on the target object due to the presence of the power source that applies the AC voltage to the electrodes, and/or due to the wires that electrically connect the power source and the electrodes. Further, as a result of noise caused by the induced charge, the potential amplitude of the target object becomes greater than the actual value thereof, and it is impossible to effectively eliminate such induced charge and noise.

Thus, with the electric charge generating device according to the present invention, in order to solve such problems and to achieve the objects noted above, the first power source and the second power source are disposed in confronting relation to each other, and/or the first wiring arrangement and the second wiring arrangement are disposed in confronting relation to each other.

As noted above, the first voltage applied from the first power source to the first electrode via the first wiring arrangement, and the second voltage applied from the second power source to the second electrode via the second wiring arrangement are of mutually different polarities. Owing thereto, the induced charge and noise caused by the first power source and the induced charge and noise caused by the second power source are developed respectively with mutually different polarities. Accordingly, such induced charges and noises cancel each other out mutually, and each of the induced charges and each of such noises can effectively be eliminated.

In this manner, by disposing the first power source and the second power source in confronting relation, or by disposing the first wiring arrangement and the second wiring arrangement in confronting relation, the influence of induced charge and noise caused by the first power source and the second power source, or the influence of induced charge and noise caused by the first wiring arrangement and the second wiring arrangement on potential amplitude can be eliminated. As a result, in the present invention, the first electrode and the second electrode can be constructed together integrally with the first power source, the second power source, the first wiring arrangement, and the second wiring arrangement, and it becomes unnecessary to provide any type of shielding countermeasure with respect to the first power source, the second power source, the first wiring arrangement, and the second wiring arrangement.

More specifically, with the electric charge generating device according to the present invention, the first electrode and the second electrode are exposed on a surface of a housing made from an electrically insulating material, and the first power source and the second power source, and/or the first wiring arrangement and the second wiring arrangement can be disposed inside of the housing.

As a result, the electric charge generating device can be used in a condition where the electric charge generating device is placed in close proximity to the target object. Further, since a shielding countermeasure is unnecessary, ions are not absorbed by the shield. As a result, the quantity of ions that reach the surface of the target object can be increased. In this manner, assuming that the electric charge generating device is placed in proximity to the target object and ions are generated thereby, the charge removal speed or charging speed with respect to the target object can be enhanced, together with increasing the charge removal capability or charging capability of the electric charge generating device.

Furthermore, assuming that the first power source and the second power source, and/or the first wiring arrangement and the second wiring arrangement are disposed inside of the housing, ease of use of the electric charge generating device can be enhanced.

In this case, if the first electrode and the second electrode are arranged alternately along a longitudinal direction of the first power source and the second power source and/or along a longitudinal direction of the first wiring arrangement and the second wiring arrangement, a bar type of electric charge generating device can easily be constructed. Further, by arranging the first electrode and the second electrode alternately, positive ions and negative ions can be evenly distributed in the spaces between the electric charge generating device and the target object, uniform charge removal without unevenness can be carried out, and the charge removal capability can be further enhanced. Further, an increase in potential amplitude at the target object due to the arrival periods of the positive ions and the negative ions at the target object can be suppressed.

In particular, assuming that the first electrode and the second electrode are arranged alternately along the longitudinal direction as viewed in plan between the first power source and the second power source and/or between the first wiring arrangement and the second wiring arrangement, since the first electrode and the second electrode are disposed on a virtual line, the first power source and the second power source, or the first wiring arrangement and the second wiring arrangement are arranged symmetrically with respect to the virtual line.

Consequently, induced charge and noise caused by the first power source and induced charge and noise caused by the second power source cancel each other out, and at the same time, induced charge and noise caused by the first wiring arrangement and induced charge and noise caused by the second wiring arrangement also cancel each other out. As a result, the influence of induced charge and noise on potential amplitude can effectively be eliminated. Further, an increase in potential amplitude due to the arrival periods of the positive ions and the negative ions at the target object can effectively be suppressed.

Further, in the case that a plurality of first electrodes and a plurality of second electrodes are arranged on a virtual circle as viewed in plan, the first wiring arrangement and the first power source connected to the first electrodes, and the second wiring arrangement and the second power source connected to the second electrodes are capable of being arranged in point symmetry with respect to the center of the virtual circle. As a result, induced charge and noise caused by the first power source and induced charge and noise caused by the second power source can effectively cancel each other out, and at the same time, induced charge and noise caused by the first wiring arrangement and induced charge and noise caused by the second wiring arrangement can effectively cancel each other out. In this case as well, an increase in potential amplitude due to the arrival periods of the positive ions and the negative ions at the target object can effectively be suppressed.

Moreover, if the needle electrode, the distal end of which is exposed to the exterior, is provided for the first electrode and the second electrode, as a result of the electrical field concentration at the distal end, positive ions and negative ions can easily be generated, whereby it is possible to further increase the charge removal capability and charging capability of the electric charge generating device.

The structure and arrangement conditions of the first power source, the second power source, the first wiring arrangement, and the second wiring arrangement of the electric charge generating device according to the present invention will be described in greater detail below in relation to the following configurations (1) through (9).

(1) The electric charge generating device releases ions generated in the vicinity of the first electrode and ions generated in the vicinity of the second electrode toward a target object. In this case, the first power source and the second power source are disposed substantially in parallel with respect to the target object, and/or the first wiring arrangement and the second wiring arrangement are disposed substantially in parallel with respect to the target object. Consequently, induced charge and noise caused by the first power source and induced charge and noise caused by the second power source cancel each other out, and in addition, induced charge and noise caused by the first wiring arrangement and induced charge and noise caused by the second wiring arrangement cancel each other out. As a result, the actual potential amplitude at the target object can be reduced.

(2) In the case of the aforementioned configuration (1), the first power source and the second power source are disposed substantially in parallel with respect to the target object at locations of substantially the same distance from the target object, and/or the first wiring arrangement and the second wiring arrangement are disposed substantially in parallel with respect to the target object at locations of substantially the same distance from the target object. Consequently, since each of the induced charges and each of the noises discussed above are reliably cancelled out, the actual potential amplitude can be further reduced.

(3) In the case of the above-described configuration (2), the first power source generates a first AC voltage, and the second power source generates a second AC voltage, which is 180° out of phase with the first AC voltage, and by application of the first AC voltage from the first power source to the first electrode via the first wiring arrangement, and application of the second AC voltage from the second power source to the second electrode via the second wiring arrangement, generation of positive ions in the vicinity of the first electrode together with generation of negative ions in the vicinity of the second electrode, and generation of negative ions in the vicinity of the first electrode together with generation of positive ions in the vicinity of the second electrode are carried out alternately. As a result, in the charge removal space, positive ions and negative ions are distributed uniformly, and uniform removal of charge without unevenness can be carried out. Further, an increase in potential amplitude caused by the arrival periods of the positive ions and the negative ions at the target object can be suppressed.

(4) In the case of the above-described configuration (3), the first power source comprises a first circuit board, a first positive voltage generator disposed on the first circuit board and which generates a positive voltage of the first AC voltage, and a first negative voltage generator disposed on the first circuit board and which generates a negative voltage of the first AC voltage. Further, the second power source comprises a second circuit board, a second positive voltage generator disposed on the second circuit board and which generates a positive voltage of the second AC voltage, and a second negative voltage generator disposed on the second circuit board and which generates a negative voltage of the second AC voltage. In addition, the first circuit board and the second circuit board are disposed upright and mutually in parallel with respect to the target object. If constituted in this manner, the aforementioned induced charge and noise can reliably be cancelled, and the actual potential amplitude can be further reduced.

(5) In the case of the above-described configuration (4), the first positive voltage generator and the second negative voltage generator confront each other, and the first negative voltage generator and the second positive voltage generator confront each other. More specifically, two voltage generators having the same structure are prepared, and if one of the voltage generators is disposed in confronting relation to the other voltage generator in a state of being rotated by 180° with respect thereto, the structure of configuration (5) can be realized. As a result, an advantage can easily be obtained in which the above-described induced charge and noise are reduced.

(6) In the case of the above-described configuration (5), a voltage supply source for supplying a power source voltage to the first positive voltage generator, the first negative voltage generator, the second positive voltage generator, and the second negative voltage generator is disposed between a central portion of the first circuit board and a central portion of the second circuit board. In this case, the first positive voltage generator, the voltage supply source, and the first negative voltage generator are arranged in this order on the first circuit board substantially in parallel with respect to the target object. Further, the second negative voltage generator, the voltage supply source, and the second positive voltage generator are arranged in this order on the second circuit board substantially in parallel with respect to the target object.

In this case, since the first power source and the second power source are arranged symmetrically about the voltage supply source, an advantage can easily be obtained in which the above-described induced charge and noise are reduced, together with improving mass production of the electric charge generating device.

(7) In the case of the above-described configuration (6), the voltage supply source is a DC power source which generates a DC voltage by supply of power thereto from the exterior. For this purpose, the inverter circuits that convert the DC voltage into an AC voltage preferably are arranged, respectively, on the first circuit board at a location between the DC power source and the first positive voltage generator, on the first circuit board at a location between the DC power source and the first negative voltage generator, on the second circuit board at a location between the DC power source and the second positive voltage generator, and on the second circuit board at a location between the DC power source and the second negative voltage generator.

In this case, the first positive voltage generator generates a positive voltage of the first AC voltage by extracting only a positive portion of the AC voltage after conversion thereof, and amplifying the extracted positive portion. Further, the first negative voltage generator generates a negative voltage of the first AC voltage by extracting only a negative portion of the AC voltage after conversion thereof, and amplifying the extracted negative portion. Furthermore, the second positive voltage generator generates a positive voltage of the second AC voltage by extracting only a positive portion of the AC voltage after conversion thereof, and amplifying the extracted positive portion. Still further, the second negative voltage generator generates a negative voltage of the second AC voltage by extracting only a negative portion of the AC voltage after conversion thereof, and amplifying the extracted negative portion.

As a result, the DC voltage supplied from the exterior is converted, and the first AC voltage and the second AC voltage can be generated from the DC voltage after conversion thereof.

(8) In the case of the above-described configurations (1) through (7), the first wiring arrangement comprises a first extraction line for extracting the first voltage generated by the first power source, a first supply line connected to the first extraction line and extending substantially in parallel with respect to the target object, and a first distribution line connected to the first supply line and connected electrically with the first electrode. Also, the second wiring arrangement comprises a second extraction line for extracting the second voltage generated by the second power source, a second supply line connected to the second extraction line and extending substantially in parallel with respect to the target object, and a second distribution line connected to the second supply line and connected electrically with the second electrode.

According to such a structure, induced charge and noise caused by the first wiring arrangement and induced charge and noise caused by the second wiring arrangement can effectively cancel each other out.

(9) In the case of the above-described configuration (8), the first extraction line and the second extraction line are arranged in confronting relation to each other, and the first supply line and the second supply line are arranged in confronting relation to each other. Owing thereto, induced charge and noise caused by the first wiring arrangement and induced charge and noise caused by the second wiring arrangement can reliably cancel each other out.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

A preferred embodiment of an electric charge generating device according to the present invention will be described in detail below with reference to the accompanying drawings.

Figure 1:
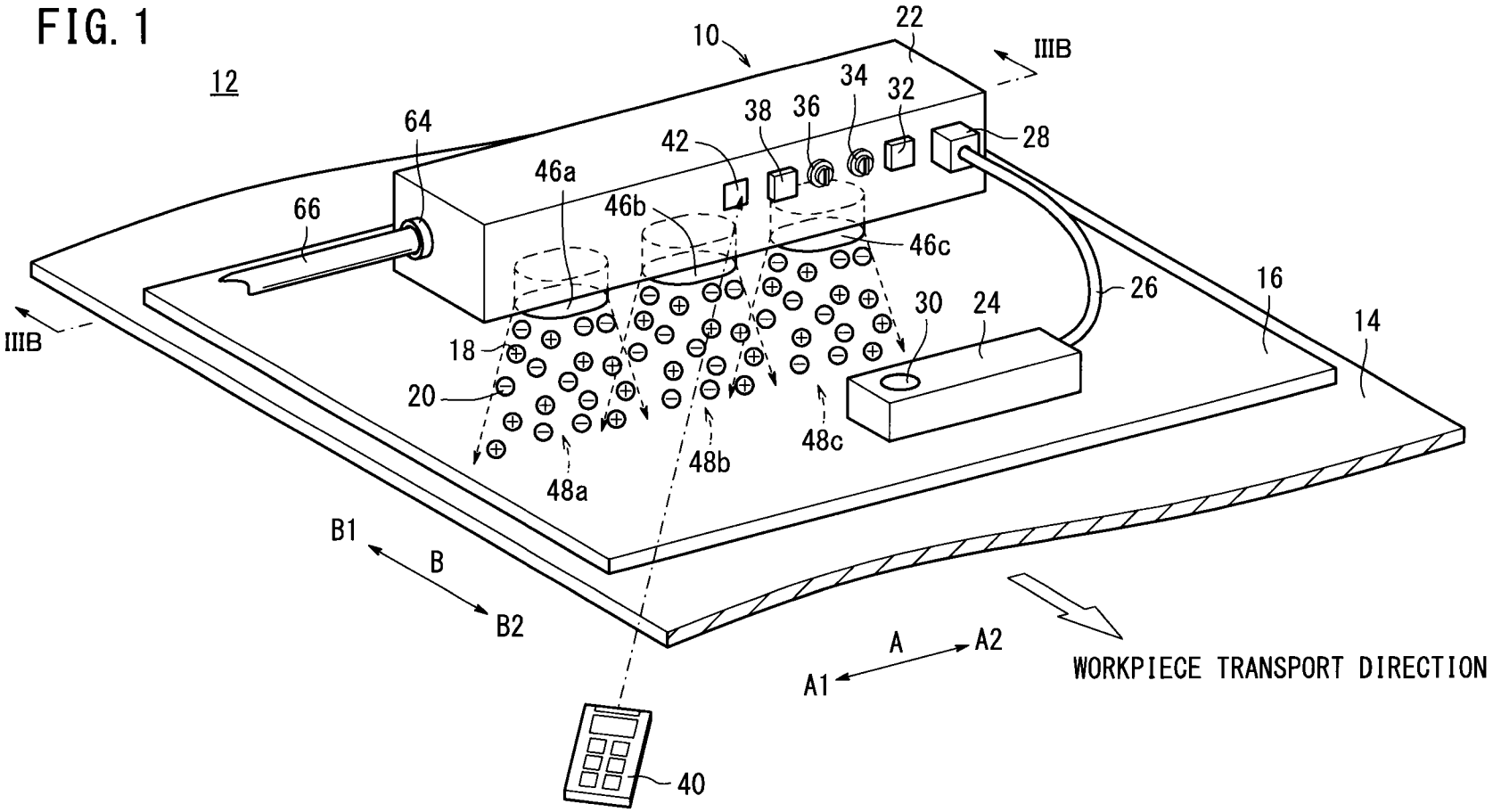
FIG. 1 is a perspective view of a charge removal system equipped with an ionizer according to a present exemplary embodiment.

FIG. 1 is a perspective view of a charge removal system 12 equipped with an ionizer 10 serving as an electric charge generating device according to the present embodiment.

Figure 2:
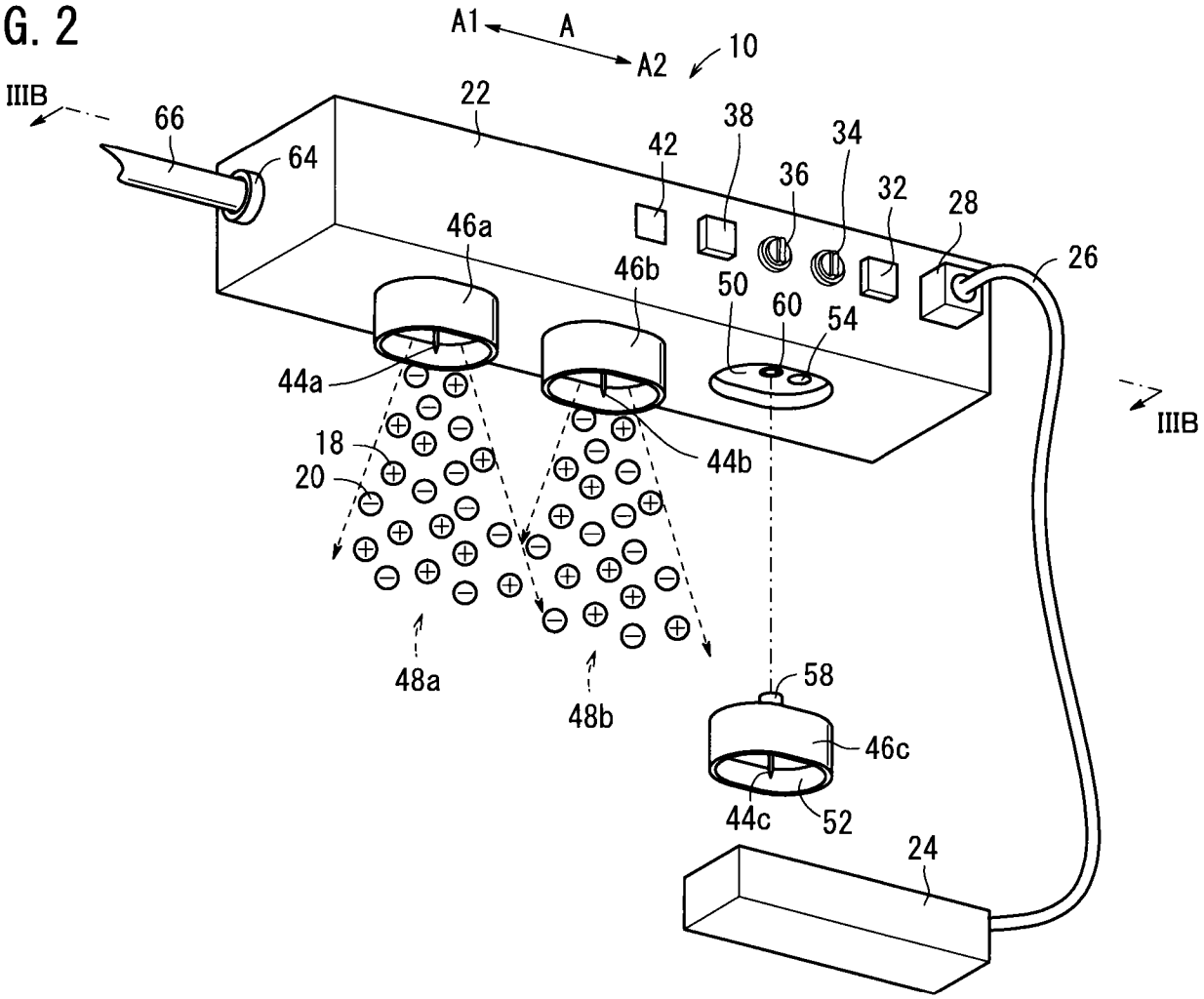
FIG. 2 is a perspective view of the ionizer shown in FIG. 1.
Figure 3A:
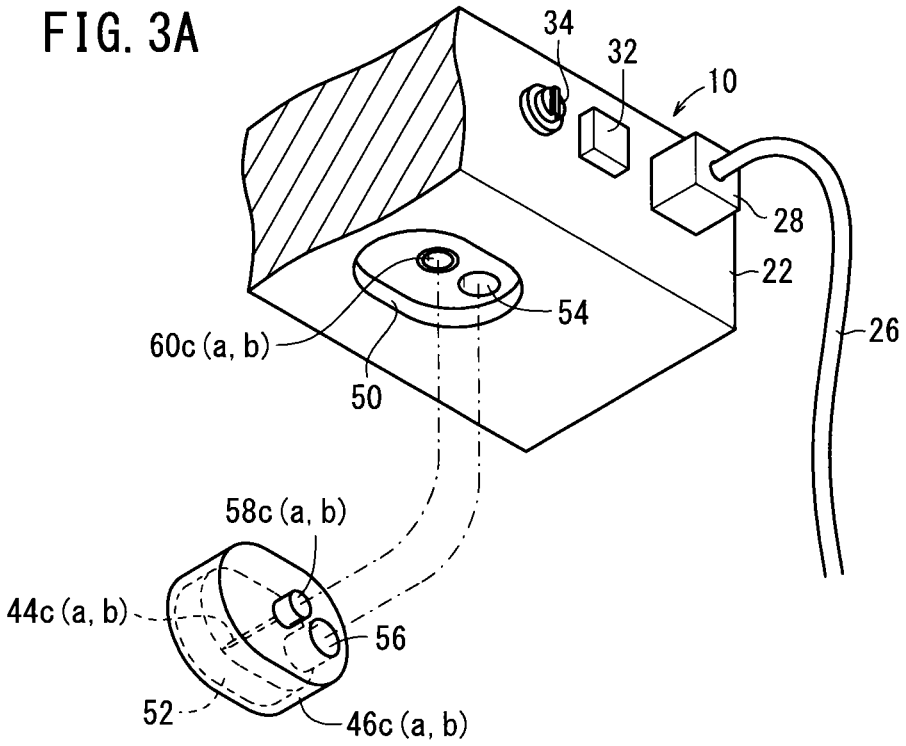
FIG. 3A is a perspective view showing a condition in which an electrode cartridge is taken out from an ionizer housing.
Figure 3B:
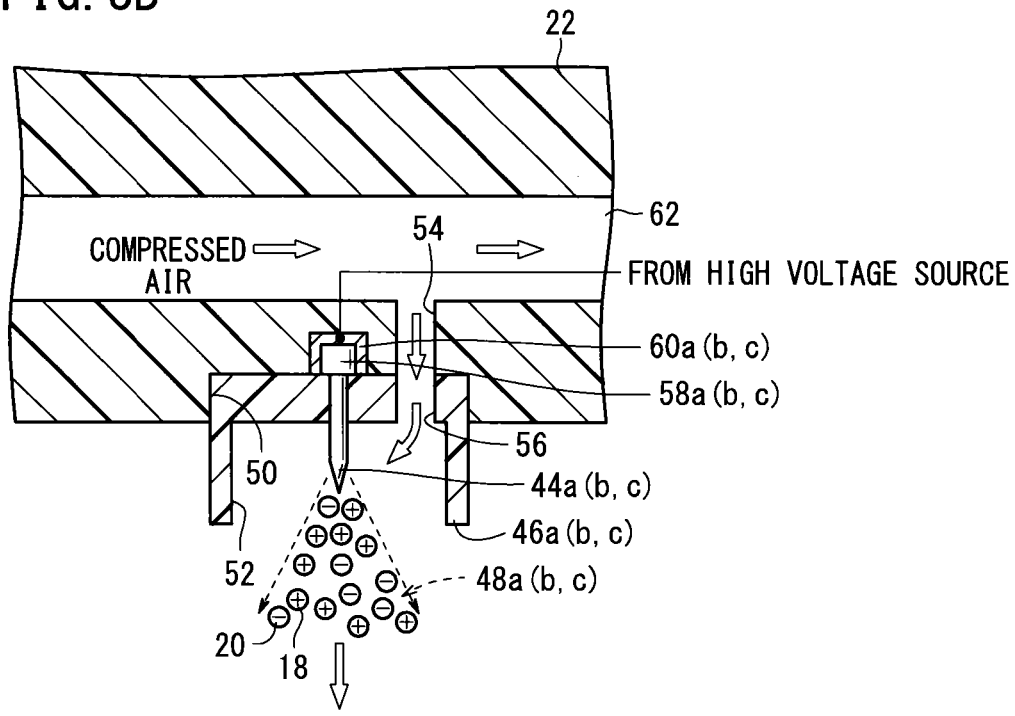
FIG. 3B is a cross sectional view taken along line IIIB-IIIB of FIG. 1 and FIG. 2.

As shown in FIGS. 1 and 2, the charge removal system 12 releases positive ions 18 and negative ions 20 from the ionizer 10 with respect to a workpiece (target object) 16, which is a target object from which static charge is to be removed, and which is conveyed on a conveyor 14. Thus, the charge removal system 12 operates to neutralize positive or negative charges that charge the workpiece 16 and to remove the charges from the workpiece 16. The workpiece 16, for example, may be a film or a glass substrate. Accordingly, the charge removal system 12 is applicable for removing charge from the glass substrate or the film, which is transported on a conveyor 14 in a factory or the like. Further, to facilitate understanding, in FIGS. 1 and 2, etc., the circled plus signs (+) indicate positive ions in exaggerated form, whereas the circled minus signs (−) indicate negative ions in exaggerated form.

The ionizer 10 includes a housing 22 of a roughly rectangular parallelepiped shape made from an electrically insulating material. The housing 22 is arranged at a position above the conveyor 14 that transports the workpiece 16 along a widthwise direction of the conveyor 14 and the workpiece 16, and is disposed substantially in parallel with the conveyor 14 and the workpiece 16, along a direction A substantially perpendicular to the direction in which the workpiece 16 is conveyed. A surface potential sensor 24, which serves as a potential measuring device, is connected via a cable 26 and a connector 28, and is disposed in proximity to the front of the workpiece 16 (at a side surface thereof on the side of the direction B2, which is the transport direction of the workpiece 16). The surface potential sensor 24 is arranged in the vicinity of the surface of the workpiece 16 for detecting, at a detection plate 30 that acts as a detection surface, a potential corresponding to the balance (ion balance) in the quantity of positive ions 18 and negative ions 20.

Further, on the front face of the housing 22, there are arranged a display unit 32 such as an LED lamp or the like, a frequency selection switch 34, an ion balance adjusting switch 36 for adjusting ion balance, an operation mode selection switch 38 for selecting a condition (operation mode) at which positive ions 18 and negative ions 20 are released from the ionizer 10, and a light receiving element 42 for receiving infrared light which is sent from a remote controller 40. The remote controller 40 controls the ionizer 10 remotely by supply of infrared light to the light receiving element 42 responsive to operated content (indicated commands) from the user.

Figure 4:
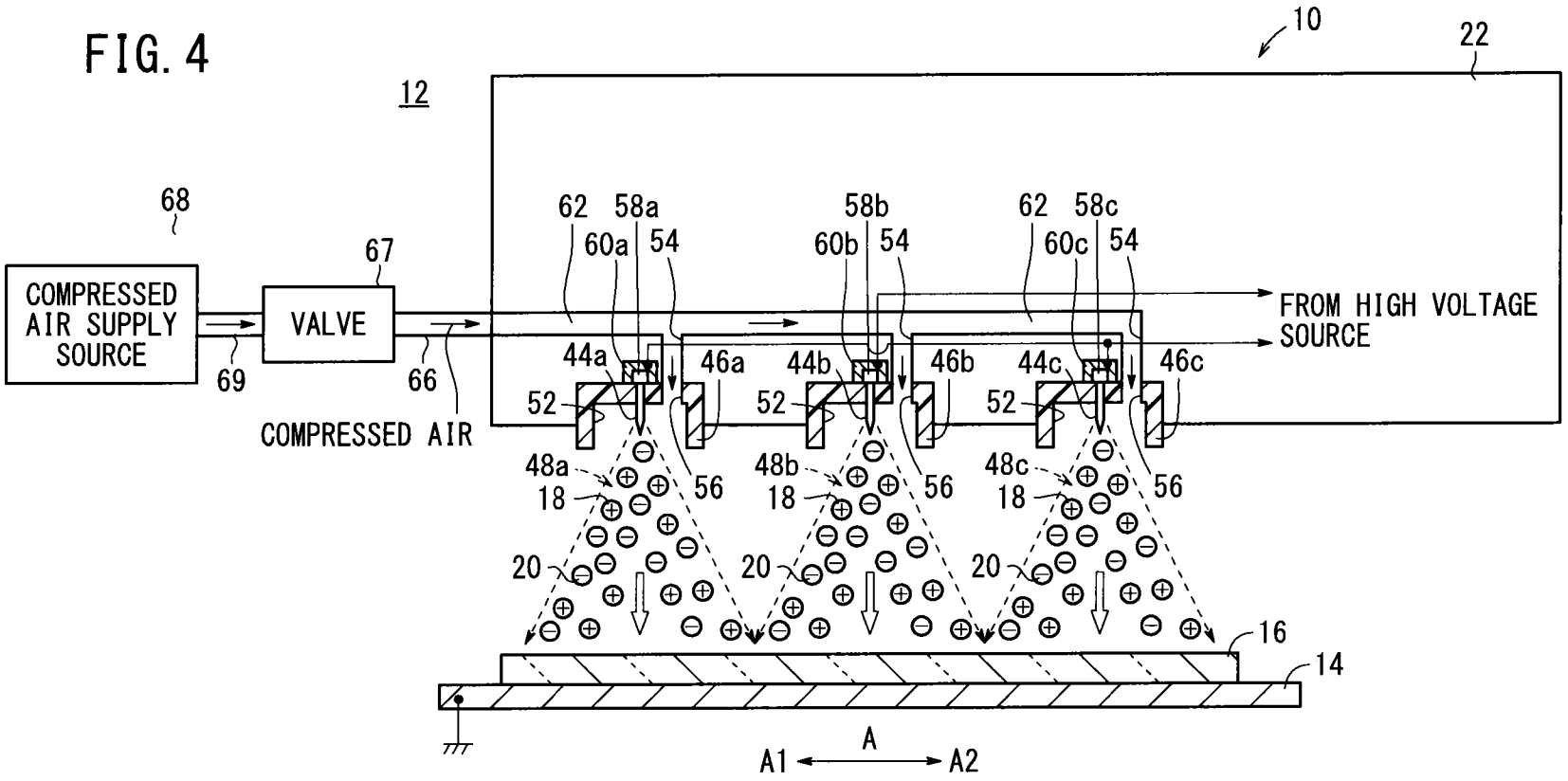
FIG. 4 is an outline explanatory drawing showing the release of ions from the ionizer of FIG. 1.

As shown in FIGS. 1 through 4, on the bottom surface of the housing 22 confronting the workpiece 16, electrode cartridges 46*a* to 46*c* equipped with tungsten (W) or silicon (Si) needle electrodes (first electrodes, second electrodes) 44*a* to 44*c* are mounted in series at predetermined intervals along the longitudinal direction (A direction) of the housing 22. In FIGS. 1, 2 and 4, as one example, a case is shown in which three electrode cartridges 46*a* to 46*c* are installed on the bottom surface of the housing 22. However, it goes without saying that three or more of such electrode cartridges can be installed in series along the A direction. Further, as shown in FIGS. 2 and 3A, the electrode cartridges 46*a* to 46*c* are mounted detachably on the bottom surface of the housing 22.

Upon application of a positive voltage to the needle electrodes 44*a* to 44*c*, by way of corona discharge caused by electric field concentration at the distal ends of the needle electrodes 44*a* to 44*c*, positive ions 18 are generated in the vicinity of the distal ends. The generated positive ions 18 are released from the electrode cartridges 46*a* to 46*c* toward the workpiece 16. On the other hand, upon application of a negative voltage to the needle electrodes 44*a* to 44*c*, by way of corona discharge caused by electric field concentration at the distal ends of the needle electrodes 44*a* to 44*c*, negative ions 20 are generated in the vicinity of the distal ends. The generated negative ions 20 are released from the electrode cartridges 46*a* to 46*c* toward the workpiece 16.

In the present embodiment, the positive voltage applied to the needle electrodes 44*a* to 44*c* is a high voltage of positive polarity having a comparatively high voltage level, and more specifically, is the positive portion of an AC voltage (AC high voltage, first AC voltage, second AC voltage) having a comparatively high voltage level. Further, the negative voltage applied to the needle electrodes 44*a* to 44*c* is a high voltage of negative polarity having a comparatively high voltage level, and more specifically, is the negative portion of an AC voltage having a comparatively high voltage level. Moreover, in the present embodiment, the positive voltage and negative voltage applied to the needle electrodes 44*a* to 44*c* are not limited to the positive and negative portions of an AC high voltage, but may be a positive high pulse voltage or a negative high pulse voltage, or a positive DC high voltage or a negative DC high voltage.

Respective charge removal spaces 48*a* to 48*c* for carrying out charge removal by the released positive ions and negative ions are formed respectively along the A direction between the workpiece 16 and the distal end sides of the needle electrodes 44*a* to 44*c*. The charge removal spaces 48*a* to 48*c* are formed so as to widen or expand outwardly toward the workpiece 16 from the distal end sides of the needle electrodes 44*a* to 44*c*. In this case, in order to remove charges reliably as the workpiece 16 is transported on the conveyor 14, as shown in FIGS. 1 and 4, the respective charge removal spaces 48*a* to 48*c* are formed so as to cover the upper surface of the workpiece 16 along the widthwise direction of the conveyor 14. Further, in the vicinity of the surface of the workpiece 16, portions of such regions are formed to overlap mutually with one another.

The electrode cartridges 46*a* to 46*c*, which are formed in the shape of elliptical columns from an electrical insulating material, are mountable in respective recesses 50 provided on the bottom surface side of the housing 22. In this case, cavities 52 are formed respectively in the electrode cartridges 46*a* to 46*c* on bottom faces thereof on the side of the workpiece 16. Further, on the upper surface thereof on the side of the housing 22, holes 56 are formed, which communicate between the cavities 52 and holes 54 provided on the housing 22. Inwardly of the cavities 52, distal end parts of the needle electrodes 44*a* to 44*c* are formed to project toward the workpiece 16, and base end parts are formed as columnar shaped terminals 58*a* to 58*c*.

On the other hand, in the recesses 50 of the housing 22, receiving openings 60*a* to 60*c*, and holes 54 which communicate with a flow passage 62 formed in the housing 22 are provided respectively. Owing thereto, when the user attaches the respective electrode cartridges 46*a* to 46*c* to the housing 22, the receiving openings 60*a* to 60*c* and the terminals 58*a* to 58*c* are fitted together respectively, and the cavities 52 communicate with the flow passage 62 through the holes 56 and the holes 54.

On one side surface in the A1 direction on the housing 22, a flow passage 66 that communicates with the flow passage 62 is connected through a connector 64. On the upstream side of the flow passage 66, there are connected in this order a valve 67, a flow passage 69, and a compressed air supply source 68. In this case, if the valve 67 is opened, compressed air can be supplied from the compressed air supply source 68, through the flow passage 69, the valve 67, the flow passages 66, 62, the holes 54, 56, and out to the cavities 52. Consequently, as a result of compressed air being ejected toward the workpiece 16 from the cavities 52, positive ions 18 and negative ions 20 are made to reach the workpiece 16, whereby static charge removal on the workpiece 16 can be carried out.

FIGS. 5 through 9 are drawings showing structures in relation to application of voltages to five needle electrodes 44*a* to 44*e* within the internal structure of the ionizer 10. More specifically, in the ionizer 10 shown in FIGS. 5 through 9, five needle electrodes 44*a* to 44*e* are arranged therein respectively.

In the interior of the ionizer 10, there are arranged an AC high voltage power source 72 equipped with a first high voltage power source 70A and a second high voltage power source 70B, a first wiring arrangement 74A connected electrically between the first high voltage power source 70A and three needle electrodes 44*a*, 44*c*, 44*e*, and a second wiring arrangement 74B connected electrically between the second high voltage power source 70B and two needle electrodes 44*b*, 44*d*.

In this case, in the ionizer 10, the five needle electrodes 44*a* to 44*e* are arranged in series at predetermined intervals along the A direction. For this purpose, the first high voltage power source 70A and the second high voltage power source 70B, and the first wiring arrangement 74A and the second wiring arrangement 74B also are disposed in the ionizer 10 along the A direction. Further, in the AC high voltage power source 72, a DC power source (voltage supply source) 76, which outputs a predetermined DC voltage (power source voltage) based on supply of a DC voltage (power source supply) thereto from the exterior, is interposed between a central portion of the first high voltage power source 70A and a central portion of the second high voltage power source 70B.

The first high voltage power source 70A and the second high voltage power source 70B are high voltage power sources of the same structure, and the first wiring arrangement 74A and the second wiring arrangement 74B are wires having substantially the same wiring structure.

Figure 6:
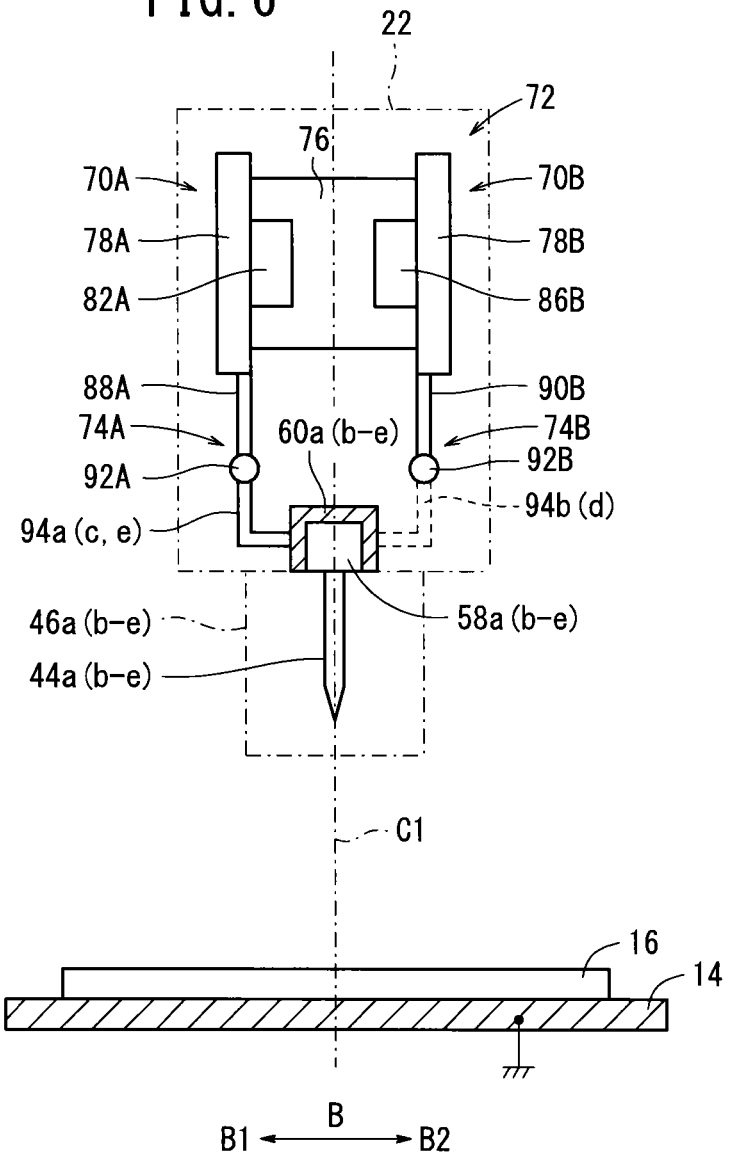
FIG. 6 is a side elevational view showing main parts in the interior of the ionizer of FIG. 1.

As shown by the side plan view of FIG. 6, the needle electrodes 44*a* to 44*e* and the DC power source 76 are arranged on an axis C1 along the vertical direction. Further, the first high voltage power source 70A and the second high voltage power source 70B are arranged symmetrically about the axis C1 in confronting relation to each other. Also, the first wiring arrangement 74A and the second wiring arrangement 74B are arranged symmetrically about the axis C1 in confronting relation to each other. More specifically, the first high voltage power source 70A and the first wiring arrangement 74A are disposed on the side of the B1 direction relative to the axis C1 (on an upstream side of the transport direction of the workpiece 16), whereas the second high voltage power source 70B and the second wiring arrangement 74B are disposed on the side of the B2 direction relative to the axis C1 (on a downstream side of the transport direction of the workpiece 16).

Figure 7B:
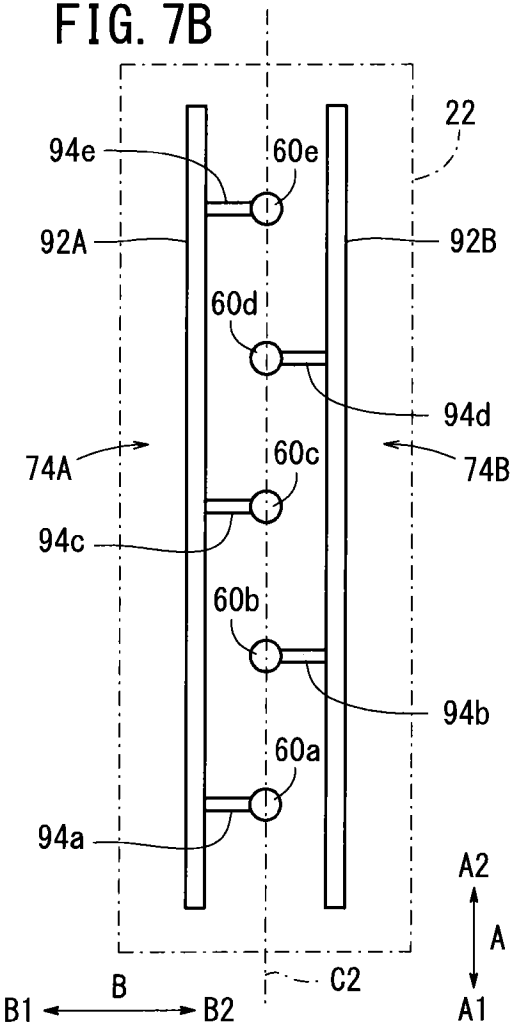
FIGS. 7A and 7B are plan views showing main parts in the interior of the ionizer of FIG. 1.
Figure 7A:
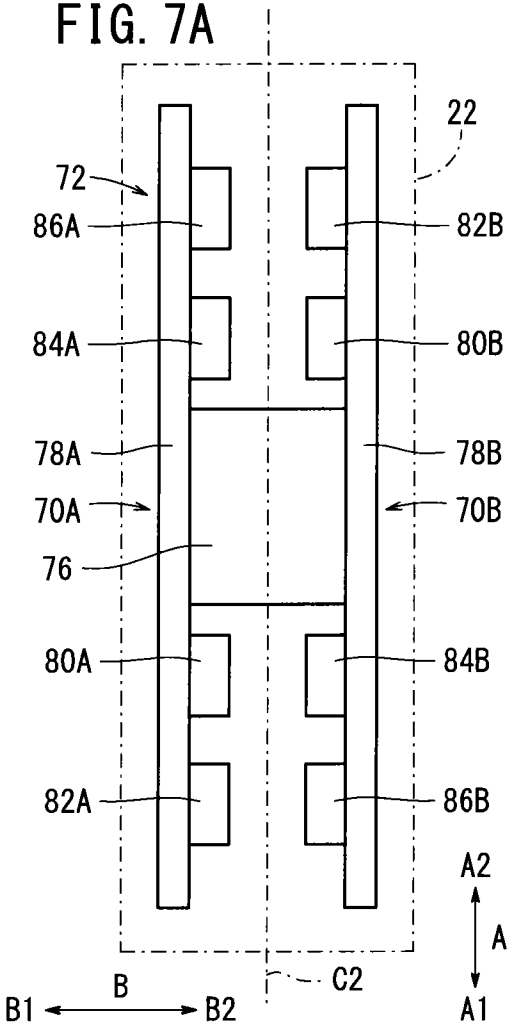

Further, as shown in plan in FIGS. 7A and 7B, the needle electrodes 44*a* to 44*e* (see FIGS. 5, 6 and 8) and the DC power source 76 are disposed on an axis C2 along the A direction. Further, the first high voltage power source 70A and the second high voltage power source 70B are arranged in confronting relation to each other symmetrically about the axis C2, and the first wiring arrangement 74A and the second wiring arrangement 74B are arranged in confronting relation to each other symmetrically about the axis C2. In this case as well, the first high voltage power source 70A and the first wiring arrangement 74A are arranged on the side of the B1 direction relative to the axis C2, and the second high voltage power source 70B and the second wiring arrangement 74B are arranged on the side of the B2 direction relative to the axis C2.

Figure 5:
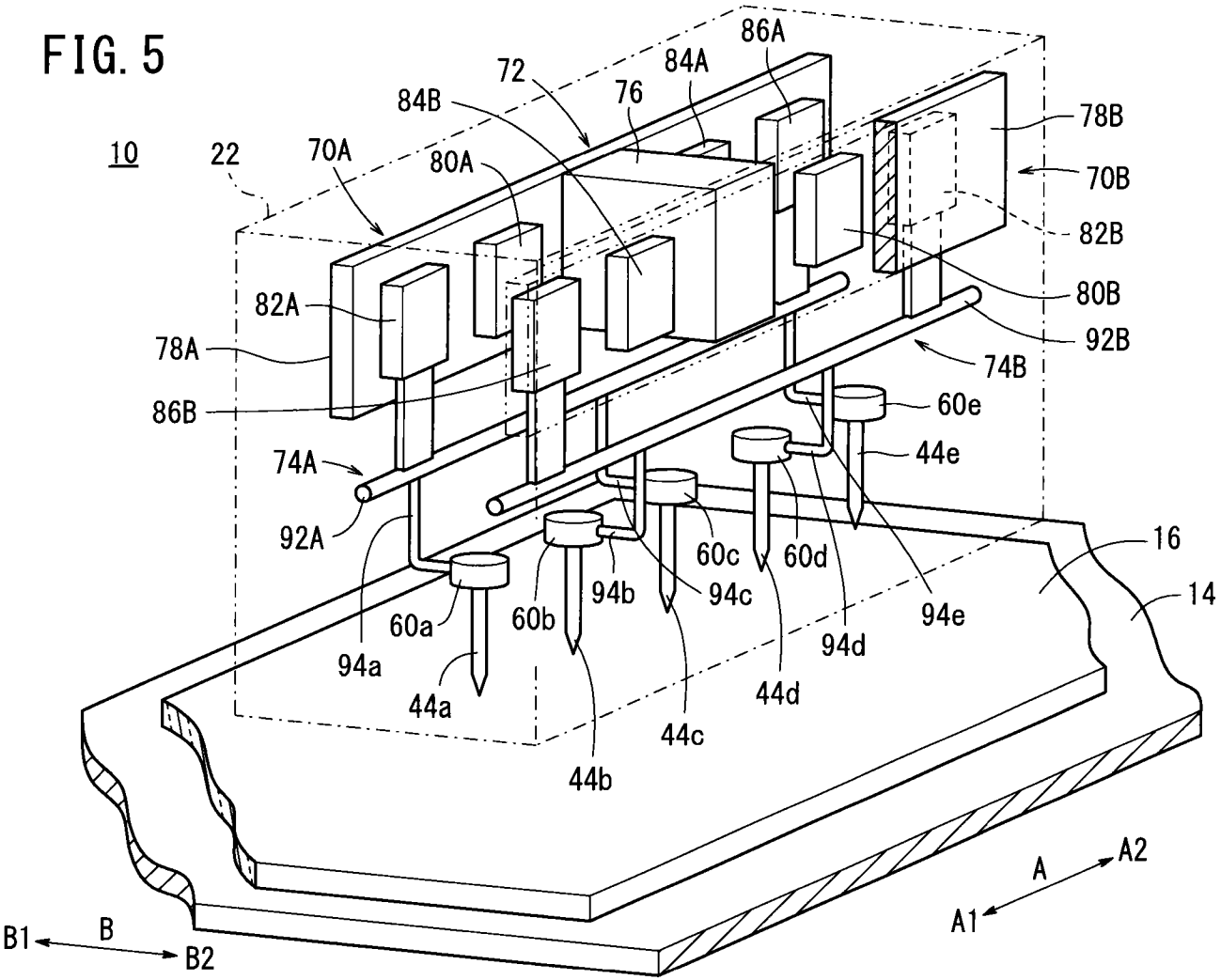
FIG. 5 is a perspective view showing main parts in the interior of the ionizer of FIG. 1.
Figure 8:
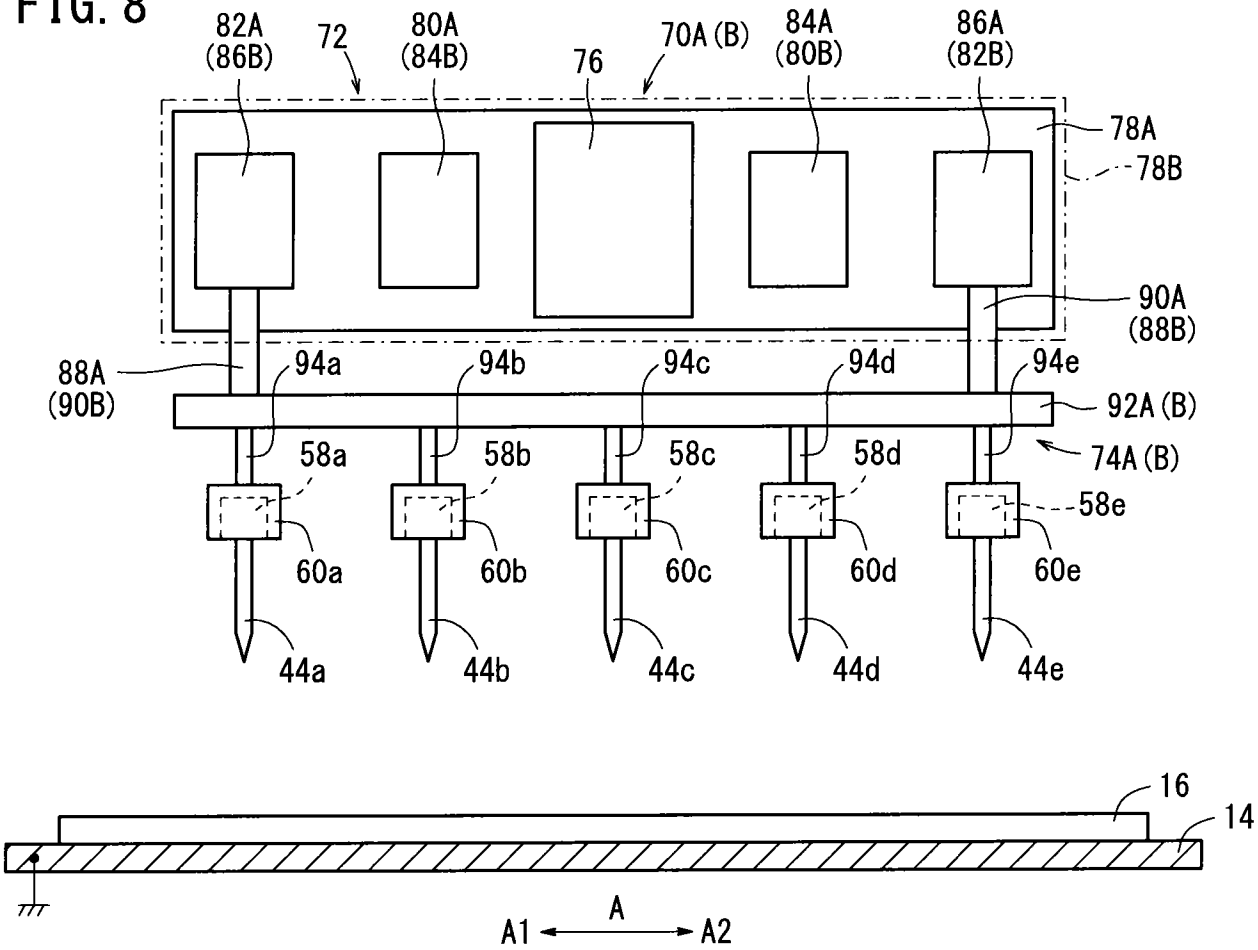
FIG. 8 is a front view showing main parts in the interior of the ionizer of FIG. 1.
Figure 9:
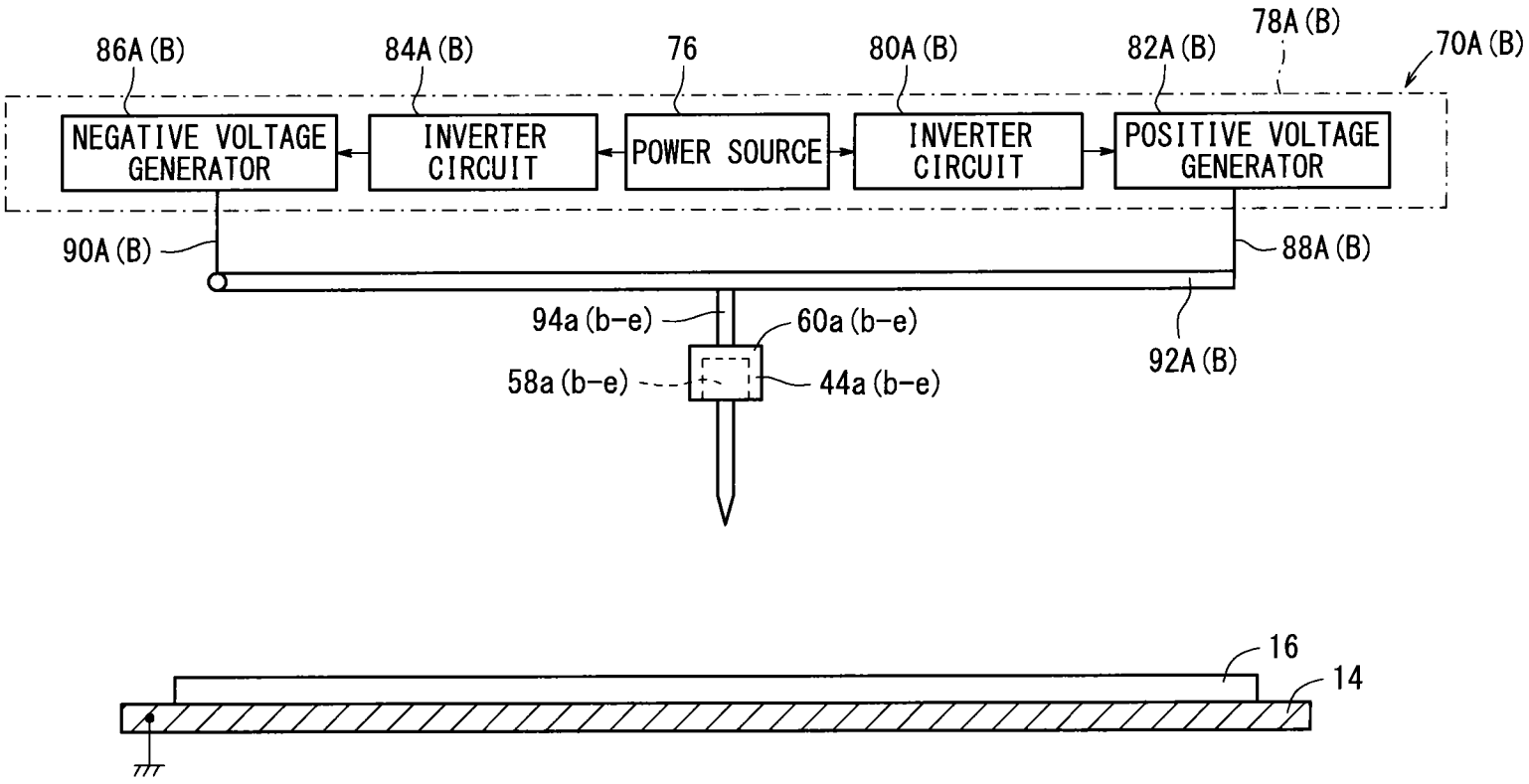
FIG. 9 is a schematic block diagram illustrating the configuration shown in FIG. 8.

For this reason, as shown in FIGS. 5, 6 and 8, the first high voltage power source 70A and the second high voltage power source 70B are arranged substantially in parallel along the A direction at positions of substantially the same height with respect to the conveyor 14 and the workpiece 16. In addition, the first wiring arrangement 74A and the second wiring arrangement 74B are arranged substantially in parallel along the A direction at positions of substantially the same height with respect to the conveyor 14 and the workpiece 16. In FIG. 8, for facilitating understanding of the description, the constituent elements of the second high voltage power source 70B are illustrated in part by a one-dot dashed line.

Concerning the respective needle electrodes 44*a* to 44*e*, which are arranged in series along the direction A, in the case of being counted from the A1 direction to the A2 direction, three odd numbered needle electrodes 44*a*, 44*c*, 44*e* are connected electrically to the first wiring arrangement 74A, whereas two even numbered needle electrodes 44*b*, 44*d* are connected electrically to the second wiring arrangement 74B. Accordingly, the first high voltage power source 70A is connected via the first wiring arrangement 74A to the odd numbered needle electrodes 44*a*, 44*c*, 44*e*. Further, the second high voltage power source 70B is connected via the second wiring arrangement 74B to the even numbered needle electrodes 44*b*, 44*d*. Stated otherwise, in the ionizer 10, the needle electrodes 44*a*, 44*c*, 44*e* connected electrically to the first high voltage power source 70A, and the needle electrodes 44*b*, 44*d* connected electrically to the second high voltage power source 70B are arranged alternately along the A direction.

Detailed constituent features of the first high voltage power source 70A, the second high voltage power source 70B, the first wiring arrangement 74A, and the second wiring arrangement 74B will be described below with reference to FIGS. 5 through 9.

The first high voltage power source 70A includes a first circuit board 78A erected in an upstanding manner with respect to the conveyor 14 and the workpiece 16. One end of the DC power source 76 is attached to a central portion of the first circuit board 78A. In this case, the surface on the B2 direction side of the first circuit board 78A is a surface that confronts the second high voltage power source 70B. On the B2 direction side surface, an inverter circuit 80A and a first positive voltage generator 82A are arranged in series in the A1 direction from the DC power source 76, whereas an inverter circuit 84A and a first negative voltage generator 86A are arranged in series in the A2 direction from the DC power source 76.

The inverter circuits 80A, 84A have inverters and transformers incorporated therein. A power source voltage (DC voltage) output from the DC power source 76 as a primary side of the first high voltage power source 70A and the second high voltage power source 70B is converted by the inverter into an AC voltage of a desired frequency, and the post-conversion AC voltage is raised in voltage and output.

The first positive voltage generator 82A comprises a rectifier circuit and an amplifier circuit (voltage doubling circuit). In this case, in the first positive voltage generator 82A, after being output from the inverter circuit 80A and boosted, the AC voltage is rectified by the rectifier circuit, whereby only the positive portion of the AC voltage is extracted, and the extracted positive portion is amplified by the amplifier circuit to thereby generate a positive high voltage.

The first negative voltage generator 86A comprises a rectifier circuit and an amplifier circuit (voltage doubling circuit). In this case, in the first negative voltage generator 86A, the AC voltage output from the inverter circuit 84A is rectified by the rectifier circuit, whereby only the negative portion of the AC voltage is extracted, and the extracted negative portion is amplified by the amplifier circuit to thereby generate a negative high voltage.

The second high voltage power source 70B has the same structure as the first high voltage power source 70A, and stated simply, the power source, which is of the same structure as the first high voltage power source 70A, is rotated 180° about the center thereof in a condition of confronting the first high voltage power source 70A.

More specifically, the second high voltage power source 70B includes a second circuit board 78B erected in an upstanding manner with respect to the conveyor 14 and the workpiece 16, and another end of the DC power source 76 is attached to a central portion of the second circuit board 78B. In this case, the surface on the B1 direction side of the second circuit board 78B is a surface that confronts the first high voltage power source 70A. On the B1 direction side surface, an inverter circuit 80B and a second positive voltage generator 82B are arranged in series in the A2 direction from the DC power source 76, whereas an inverter circuit 84B and a second negative voltage generator 86B are arranged in series in the A1 direction from the DC power source 76.

Accordingly, along the B direction, the inverter circuit 80A and the inverter circuit 84B confront each other, the first positive voltage generator 82A and the second negative voltage generator 86B confront each other, the inverter circuit 84A and the inverter circuit 80B confront each other, and the first negative voltage generator 86A and the second positive voltage generator 82B confront each other.

Similar to the inverter circuits 80A, 84A, in the inverter circuits 80B, 84B, a DC voltage output from the DC power source 76 is converted by the inverter into an AC voltage of a desired frequency, and the post-conversion AC voltage is raised in voltage and output. Similar to the first positive voltage generator 82A, in the second positive voltage generator 82B, the AC voltage output from the inverter circuit 80B is rectified by the rectifier circuit, whereby only the positive portion of the AC voltage is extracted, and the extracted positive portion is amplified by the amplifier circuit to thereby generate a positive high voltage. Similar to the first negative voltage generator 86A, in the second negative voltage generator 86B, the AC voltage output from the inverter circuit 84B is rectified by the rectifier circuit, whereby only the negative portion of the AC voltage is extracted, and the extracted negative portion is amplified by the amplifier circuit to thereby generate a negative high voltage.

The first wiring arrangement 74A is constituted from an extraction line (first extraction line) 88A that is suspended from the first positive voltage generator 82A, an extraction line (first extraction line) 90A that is suspended from the first negative voltage generator 86A, a first supply line 92A that extends in the A direction and is connected to the respective extraction lines 88A, 90A, and plural distribution lines (first distribution lines) 94*a*, 94*c*, 94*e* that extend from the first supply line 92A and are connected respectively to the receiving openings 60*a*, 60*c*, 60*e*.

As noted above, the first positive voltage generator 82A amplifies only the positive portion of the AC voltage to generate the positive high voltage, whereas the first negative voltage generator 86A amplifies only the negative portion of the AC voltage to generate the negative high voltage. As a result, the extraction line 88A extracts the positive high voltage from the first positive voltage generator 82A, and the extraction line 90A extracts the negative high voltage from the first negative voltage generator 86A.

Moreover, since the first positive voltage generator 82A and the first negative voltage generator 86A generate the positive high voltage and the negative high voltage, respectively, in mutually different time bands, the generated positive high voltage and the negative high voltage are 180° out of phase with each other. Therefore, the first supply line 92A generates an AC high voltage (first AC voltage), which is synthesized from the positive high voltage and the negative high voltage, whereupon the generated first AC voltage is supplied to each of the needle electrodes 44*a*, 44*c*, 44*e* via the distribution lines 94*a*, 94*c*, 94*e* and the receiving openings 60*a*, 60*c*, 60*e*.

Stated otherwise, the first high voltage power source 70A separately generates the positive high voltage (positive voltage) and the negative high voltage (negative voltage) that make up the AC high voltage (first AC voltage) using the first positive voltage generator 82A and the first negative voltage generator 86A, and supplies the same to the first supply line 92A via the extraction lines 88A, 90A.

The second wiring arrangement 74B is constructed substantially the same as the first wiring arrangement 74A, except that the needle electrodes connected thereto are the two needle electrodes 44*b*, 44*d*.

More specifically, the second wiring arrangement 74B is constituted from an extraction line (second extraction line) 88B that is suspended from the second positive voltage generator 82B, an extraction line (second extraction line) 90B that is suspended from the second negative voltage generator 86B, a second supply line 92B that extends in the A direction and is connected to the respective extraction lines 88B, 90B, and plural distribution lines (second distribution lines) 94*b*, 94*d* that extend from the second supply line 92B and are connected respectively to the receiving openings 60*b*, 60*d*.

As noted above, the first high voltage power source 70A and the second high voltage power source 70B are positioned at substantially the same height, and the first wiring arrangement 74A and the second wiring arrangement 74B are positioned at substantially the same height. Further, the respective needle electrodes 44*a* to 44*e* are arranged in series along the A direction, the first positive voltage generator 82A and the second negative voltage generator 86B confront each other, and the first negative voltage generator 86A and the second positive voltage generator 82B confront each other. Owing to this structure, the extraction line 88A and the extraction line 90B confront each other, the extraction line 90A and the extraction line 88B confront each other, and the first supply line 92A and the second supply line 92B confront each other.

Further, the second positive voltage generator 82B amplifies only the positive portion of the AC voltage to generate the positive high voltage, whereas the second negative voltage generator 86B amplifies only the negative portion of the AC voltage to generate the negative high voltage. As a result, the extraction line 88B extracts the positive high voltage from the second positive voltage generator 82B, and the extraction line 90B extracts the negative high voltage from the second negative voltage generator 86B.

Furthermore, since the second positive voltage generator 82B and the second negative voltage generator 86B generate the positive high voltage and the negative high voltage, respectively, in mutually different time bands, the generated positive high voltage and negative high voltage are 180° out of phase with each other. Therefore, the second supply line 92B generates an AC voltage (second AC voltage), which is synthesized from the positive high voltage and the negative high voltage, whereupon the generated second AC voltage is supplied to each of the needle electrodes 44*b*, 44*d* via the distribution lines 94*b*, 94*d* and the receiving openings 60*b*, 60*d*.

Stated otherwise, the second high voltage power source 70B separately generates the positive high voltage (positive voltage) and the negative high voltage (negative voltage) that make up the AC high voltage (second AC voltage) using the second positive voltage generator 82B and the second negative voltage generator 86B, and supplies the same to the second supply line 92B via the extraction lines 88B, 90B.

Figure 10:
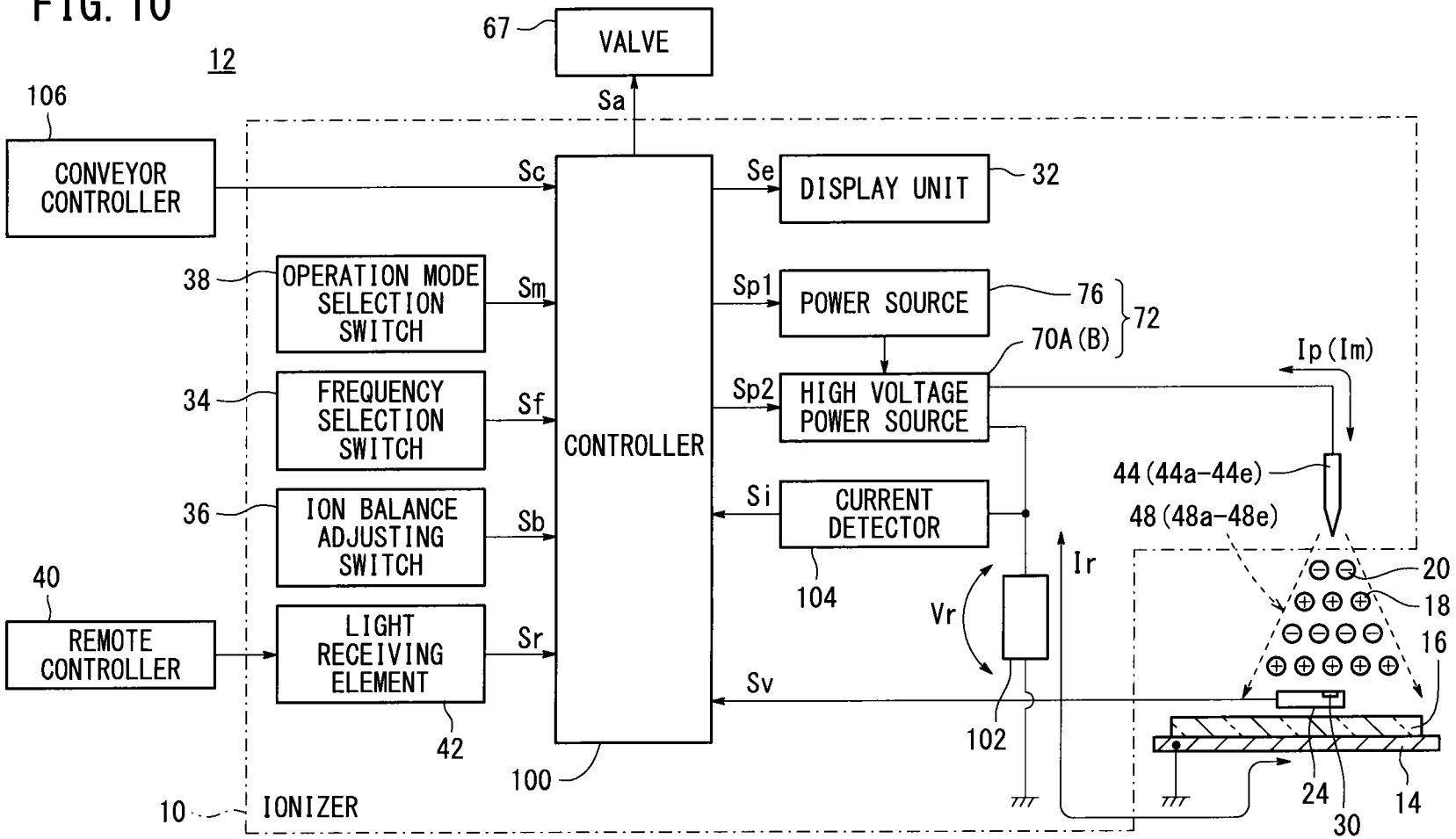
FIG. 10 is a schematic block diagram of the charge removal system of FIG. 1.

FIG. 10 is a schematic block diagram of the charge removal system 12 including the ionizer 10.

In addition to the structures described in FIGS. 1 through 9, the ionizer 10 further includes a controller 100, a resistor 102, and a current detector 104.

In this case, the needle electrodes 44*a* to 44*e* are connected to the resistor 102 through the AC high voltage power source 72, and the resistor 102 is connected to ground. Further, the conveyor 14 that conveys the workpiece 16 also functions as a grounding electrode. The conveyor 14 is controlled by a conveyor controller 106.

During times that the conveyor 14 is operated (i.e., when the workpiece is transported), the conveyor controller 106 outputs to the controller 100 a conveyor control signal Sc, which indicates that the conveyor 14 is under operation.

The frequency selection switch 34 functions as a switch by which the user can select the frequency of the AC high voltage (first AC voltage or second AC voltage) applied to the needle electrodes 44*a* to 44*e*, and outputs a signal Sf corresponding to the selected frequency to the controller 100.

The operation mode selection switch 38 is a switch for allowing the user to select a condition (operation mode) under which positive ions 18 and negative ions 20 are released from the ionizer 10, and outputs a signal Sm corresponding to the selected operation mode to the controller 100. The following may be given as examples of operation modes: a mode for releasing positive ions 18 and negative ions 20 simultaneously from the ionizer 10, a mode for releasing positive ions 18 or negative ions 20 alternately from the ionizer 10, and a mode for releasing positive ions 18 or negative ions 20 for predetermined times from the ionizer 10, etc.

The controller 100 supplies a control signal Sp1 to the DC power source 76, whereby the DC power source is controlled to generate a power source voltage (DC voltage) based on a DC voltage supplied from the exterior. Further, the controller 100 supplies a control signal Sp2 to the first high voltage power source 70A and the second high voltage power source 70B, whereby based on the power source voltage supplied from the DC power source 76, the first high voltage power source 70A and the second high voltage power source 70B are controlled to generate an AC high voltage of a desired frequency corresponding to the signal Sf.

The surface potential sensor 24 detects the potential at the position of the detection plate 30 inside the charge removal spaces 48*a* to 48*e* (hereinafter referred to collectively as the charge removal space 48), and outputs to the controller 100 a potential signal Sv indicative of the size (potential amplitude) and polarity of the detected potential.

Further, when positive ions 18 and negative ions 20 are generated due to application of the AC high voltage to the needle electrodes 44*a*, 44*c*, 44*e* from the first high voltage power source 70A, and application of the AC high voltage to the needle electrodes 44*b*, 44*d* from the second high voltage power source 70B, a positive current Ip arising from the positive ions 18, and a negative current Im arising from the negative ions 20 are generated.

The positive current Ip is a current that flows in the direction from the first high voltage power source 70A and the second high voltage power source 70B to the needle electrodes 44*a* to 44*e* (hereinafter also referred to collectively as needle electrodes 44), which is generated in the time band that the positive portion (positive voltage) of the AC high voltage is applied to the needle electrodes 44 (44*a* to 44*e*). The negative current Im is a current that flows in the direction from the needle electrodes 44 (44*a* to 44*e*) to the first high voltage power source 70A and the second high voltage power source 70B, which is generated in the time band that the negative portion (negative voltage) of the AC high voltage is applied to the needle electrodes 44 (44*a* to 44*e*).

Further, a current If (hereinafter referred to as a return current) flows in the interval from the resistor 102 to the needle electrodes 44 (44*a* to 44*e*) via ground, the conveyor 14, the workpiece 16, and the charge removal space 48 (48*a* to 48*e*), and in the resistor 102 the return current Ir acts to generate a voltage drop Vr. The current detector 104 measures the voltage drop Vr, and detects the size and direction of the return current Ir based on the measured voltage drop Vr. A current detection signal Si indicative of the size and direction of the detected return current Ir is output to the controller 100.

The return current Ir is a current corresponding to the sum of the positive current Ip and the negative current Im. In the event that the quantity of positive ions 18 is greater than the quantity of negative ions 20 ($|Ip|>|Im|$), the return current Ir flows in a direction from the conveyor 14 to the resistor 102. Conversely, in the event that the quantity of negative ions 20 is greater than the quantity of positive ions 18 ($|Ip|<|Im|$), the return current Ir flows in a direction from the resistor 102 to the conveyor 14. Further, when the positive ions 18 and the negative ions 20 are of substantially the same quantity, since the ion balance is in a balanced condition, $|Ip|$ equals $|Im|$ ($|Ip|=|Im|$), and as a result, the return current $Ir=0$.

Accordingly, based on the current detection signal Si and/or the potential signal Sv, the controller 100 can grasp the condition of ion balance in the charge removal space 48 (48*a* to 48*e*).

More specifically, the controller 100 calculates the time average of the potential and/or the return current Ir within at least one period of the AC high voltage, and from such a calculation result, determines whether or not the ion balance is in a balanced state. If the time average of the potential and/or the return current Ir is roughly zero in level, the controller 100 judges that the ion balance is in a balanced condition (i.e., that the quantity of positive ions 18 and the quantity of negative ions 20 are balanced). In this case, the controller 100 outputs a control signal Sp1 to the DC power source 76, and outputs a control signal Sp2 to the first high voltage power source 70A and the second high voltage power source 70B, so that the presently set AC high voltage continues to be applied to the needle electrodes 44 (44*a* to 44*e*).

On the other hand, if the time average of the potential and/or the return current Ir is not roughly zero, but is a value of a predetermined positive or negative level, then the controller 100 judges that the ion balance is not in a balanced condition (i.e., has collapsed), and the control signal Sp1 and the control signal Sp2 for correcting the deviation in ion balance are output. In this case, for example, the controller 100 can output the control signal Sp1 and the control signal Sp2 in order to adjust either one of the generated ion quantities from among the positive ions 18 or the negative ions 20, by increasing or decreasing one of the amplitudes of the positive voltage and the negative voltage of the AC high voltage. Accordingly, by changing the amplitude of the positive voltage or the negative voltage using the (time average of the) potential and/or the return current Ir, the controller 100 can implement a feedback control to adjust the ion balance of the positive ions 18 and the negative ions 20.

The potential detected by the surface potential sensor 24 is a potential at the location of the detection plate 30 in the vicinity of the surface of the workpiece 16, whereas the return current Ir is a current that flows between the resistor 102 and the needle electrodes 44 (44*a* to 44*e*), including the charge removal space 48 (48*a* to 48*e*). Therefore, a feedback control using the potential is capable of adjusting with high precision the ion balance at respective locations of the charge removal space 48. On the other hand, a feedback control using the return current Ir adjusts the ion balance of the totality of the charge removal space 48, or the respective charge removal spaces 48*a* to 48*e* in their entirety.

The ion balance adjusting switch 36 is provided on the ionizer 10. In the event that the ionizer 10 is of a structure that does not include the surface potential sensor 24, the resistor 102, and the current detector 104, the ionizer 10 is capable of performing ion balance adjustment in accordance with the ion balance adjusting switch 36 being operated by the user. That is, the ion balance adjusting switch 36 is used when the user adjusts the ion balance by way of a manual control.

More specifically, the user detects the potential in the vicinity of the surface of the workpiece 16 using the sensor of another potential measuring device, and then the user operates the ion balance adjusting switch 36 based on the polarity and size (potential amplitude) of the detected potential. The ion balance adjusting switch 36, for example, is a trimmer type of switch, which outputs a signal Sb to the controller 100 responsive to an amount by which the switch is operated by the user. As a result, responsive to the signal Sb, the controller 100 supplies the control signals Sp1, Sp2 respectively to the DC power source 76 and to the first high voltage power source 70A and the second high voltage power source 70B, and can perform a control to implement an ion balance as desired by the user.

Further, the remote controller 40 is equipped with the functions of the aforementioned operation mode selection switch 38, the frequency selection switch 34, and the ion balance adjusting switch 36, and transmits to the light receiving element 42 infrared rays responsive to operations from the user. The light receiving element 42 outputs to the controller 100 a signal Sr in response to the received infrared light, whereupon the controller 100 supplies the control signals Sp1, Sp2 responsive to the signal Sb respectively to the DC power source 76 and to the first high voltage power source 70A and the second high voltage power source 70B.

Furthermore, when a conveyor control signal Sc is not input thereto from the conveyor controller 106, the controller 100 determines that transportation of the workpiece 16 by the conveyor 14 has been suspended, and outputs a valve stop signal Sa to the valve 67. Based on the valve stop signal Sa input thereto, the valve 67 is switched from an open into a closed state. Consequently, release of positive ions 18 and negative ions 20 toward the workpiece 16 from the ionizer 10 can be terminated.

Still further, in the event that the controller 100 issues some type of warning or advice to the user, for example, that the needle electrodes 44*a* to 44*e* should be replaced or the like, a warning signal Se is output to the display unit 32, whereby a display can be shown on the display unit 32 based on the warning signal Se.

Figure 11:
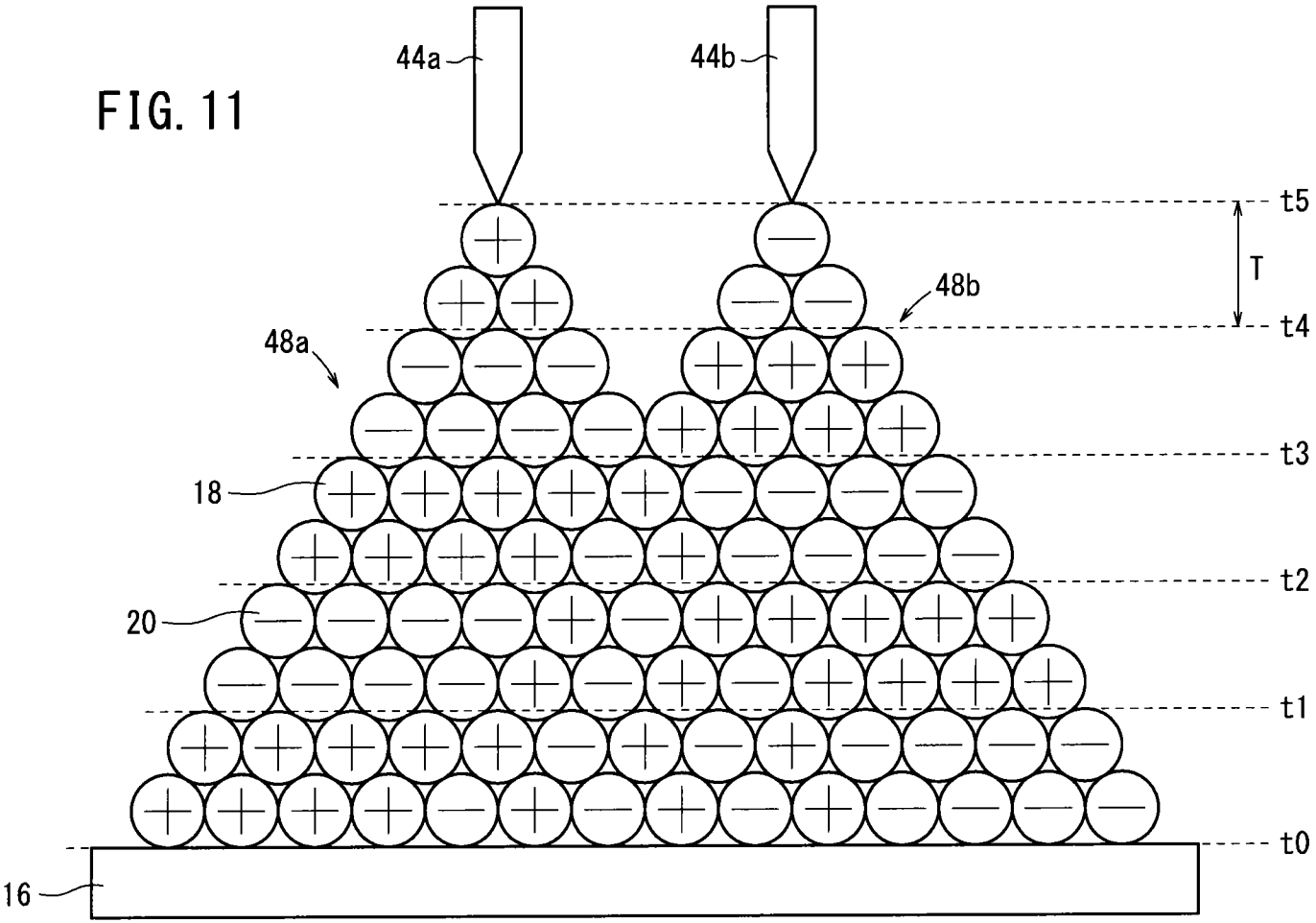
FIG. 11 is an explanatory drawing in which release of ions from the ionizer is shown schematically.
Figure 12:
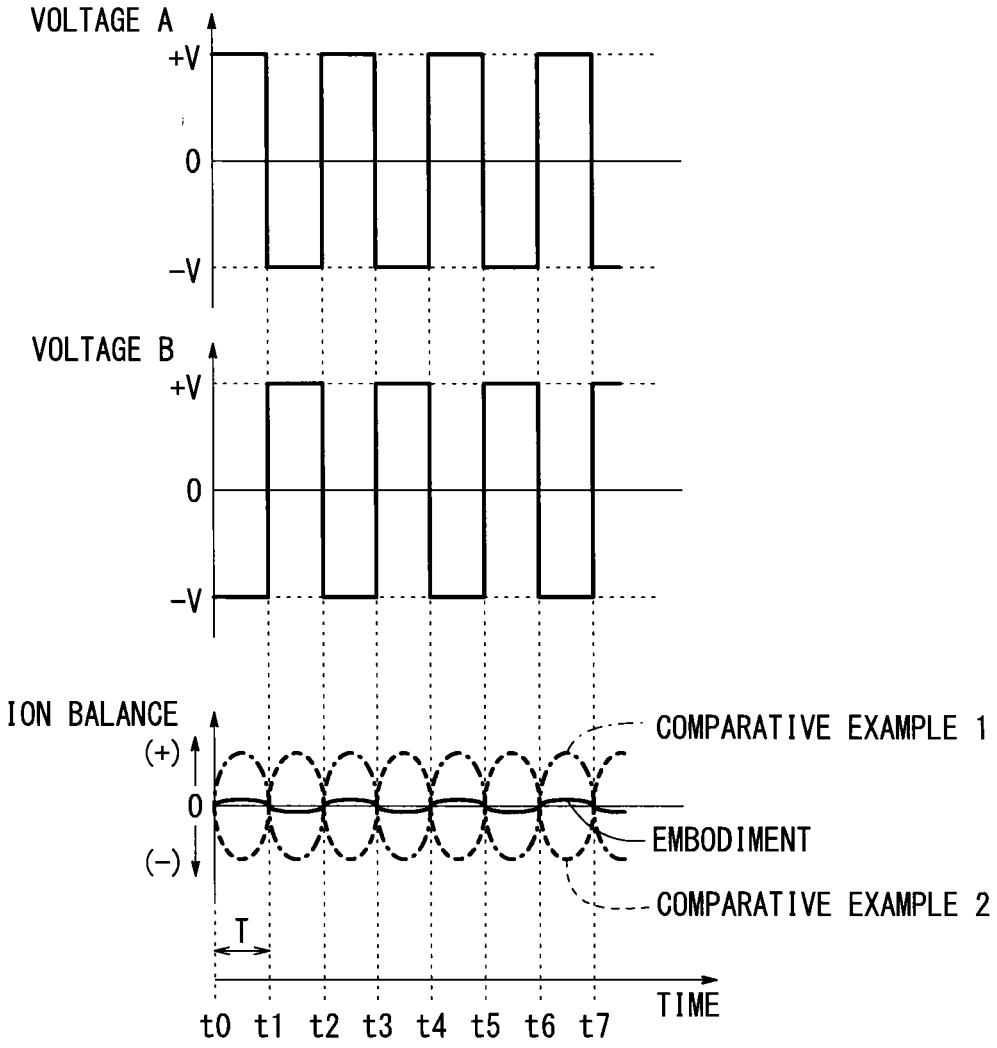
FIG. 12 is a time chart for explaining the relationship between ion balance and AC voltage applied to the needle electrodes.

FIGS. 11 and 12 are views showing removal of charge from the workpiece 16 using the ionizer 10 according to the present embodiment.

As one example, a case shall be explained in which an AC high voltage (voltage A) having an amplitude V and a period T is applied to one needle electrode 44*a*, and another AC high voltage (voltage B) having an amplitude V and a period T, which is 180° out of phase with the voltage A, is applied to another needle electrode 44*b*. Accordingly, as shown in FIG. 12, at respective times t0 to t6 each of which is of period T, the polarity of the AC high voltage applied to the needle electrodes 44*a*, 44*b* is switched.

The voltage A (first AC voltage) is applied to the one needle electrode 44*a* from the first high voltage power source 70A via the first wiring arrangement 74A, whereas the voltage B (second AC voltage) is applied to the other needle electrode 44*b* from the second high voltage power source 70B via the second wiring arrangement 74B. In this case, positive ions 18 and negative ions 20 are generated alternately in the vicinity of the respective needle electrodes 44*a*, 44*b*.

More specifically, in time bands (t0 to t1, t2 to t3, t4 to t5) during which the voltage A is positive and the voltage B is negative, positive ions 18 are generated in the vicinity of the needle electrode 44*a*, and negative ions 20 are generated in the vicinity of the needle electrode 44*b*. Further, in time bands (t1 to t2, t3 to t4, t5 to t6) during which the voltage A is negative and the voltage B is positive, negative ions 20 are generated in the vicinity of the needle electrode 44*a*, and positive ions 18 are generated in the vicinity of the needle electrode 44*b*.

Accordingly, the ionizer 10 releases positive ions 18 and negative ions 20 alternately toward the workpiece 16. In FIG. 11, it is shown schematically how such positive ions 18 and negative ions 20 are released respectively in each of the time bands and arrive at the workpiece 16 in sequential order. Further, in FIG. 11, for facilitating understanding, the time bands during which the positive ions 18 and the negative ions 20 are generated are indicated using the respective times t0 to t5 and the period T.

As shown in FIG. 11, within the charge removal spaces 48*a*, 48*a*, regions thereof between the needle electrode 44*a* and the needle electrode 44*b* in the vicinity of the workpiece 16 partially overlap one another. Therefore, at such regions and within the same time bands, ions from the side of the needle electrode 44*a*, and ions from the side of the needle electrode 44*b* are intermixed.

Further, in FIG. 12, timewise changes in ion balance (i.e., timewise changes in potential amplitude as detected by the surface potential sensor 24) are shown. In the case of the present embodiment (exemplary embodiment), a slight timewise change in ion balance can be seen, however, the timewise change is suppressed to remain within the neighborhood of a roughly zero level. Stated otherwise, the ion balance is in a state that is substantially balanced.

As noted above, an AC high voltage is applied to the needle electrodes 44*a*, 44*b*, whereby positive ions 18 and negative ions 20 are generated alternately. Consequently, since the positive ions 18 and the negative ions 20 arrive at the workpiece 16 in the same time band, the potential amplitude is suppressed substantially to a zero level. In particular, at the aforementioned region between the needle electrode 44*a* and the needle electrode 44*b*, since a mixed state of positive ions 18 and negative ions 20 occurs, the potential amplitude can effectively be suppressed.

With the present embodiment, as noted previously, the first high voltage power source 70A and the second high voltage power source 70B, which have the same structure, are positioned substantially at the same height with respect to the conveyor 14 and the workpiece 16 symmetrically with respect to the axes C1, C2, and further, are arranged in confronting relation to each other. Additionally, the second high voltage power source 70B is arranged to confront and is rotated by 180° with respect to the first high voltage power source 70A, such that the positive voltage generating portion in the first high voltage power source 70A and the negative voltage generating portion in the second high voltage power source 70B confront each other, and the negative voltage generating portion in the first high voltage power source 70A and the positive voltage generating portion in the second high voltage power source 70B confront each other.

Further, the first wiring arrangement 74A and the second wiring arrangement 74B, which have substantially the same structure, also are positioned substantially at the same height with respect to the conveyor 14 and the workpiece 16 symmetrically with respect to the axes C1, C2, and further, are arranged in confronting relation to each other.

Moreover, the needle electrodes 44*a* to 44*e* are arranged along the axes C1, C2, the voltage A (first AC voltage) is applied to the odd numbered needle electrodes 44*a*, 44*c*, 44*e*, and the voltage B (second AC voltage), which is 180° out of phase with the voltage A, is applied to the even numbered needle electrodes 44*b*, 44*d*.

If constructed in this manner, during application of AC high voltages to (i.e., during generation of positive ions 18 and negative ions 20 from) the needle electrodes 44*a* to 44*e*, charge that is induced on the workpiece 16 due to the first high voltage power source 70A and the second high voltage power source 70B, noise with respect to potential amplitude caused by such charge, charge that is induced on the workpiece 16 due to the first wiring arrangement 74A and the second wiring arrangement 74B, and noise with respect to potential amplitude caused by such charge can be suppressed. In the following descriptions, the charge induced on the workpiece 16 will be referred to as an "induced charge".

More specifically, the AC high voltage power source 72, which comprises the first high voltage power source 70A, the second high voltage power source 70B, the first wiring arrangement 74A, and the second wiring arrangement 74B, is constructed as described above, and the difference in phase between the voltage A and the voltage B is set to be 180°. As a result, induced charge and noise caused by the first high voltage power source 70A, and induced charge and noise caused by the second high voltage power source 70B differ in polarity and cancel each other out mutually. Further, induced charge and noise caused by the first wiring arrangement 74A, and induced charge and noise caused by the second wiring arrangement 74B differ in polarity and cancel each other out mutually. As a result, the influence of induced charge and noise on potential amplitude can be eliminated.

Thus, the time chart of ion balance of the exemplary embodiment shown in FIG. 12 can be obtained by the effect of reducing induced charge and noise, and by the effect of suppression of potential amplitude by arrival of positive ions 18 and negative ions 20 on the surface of the workpiece 16 within the same time band.

On the other hand, in FIG. 12, comparative example 1 and comparative example 2 are detected results of ion balance for cases in which the aforementioned countermeasures in relation to induced charge and noise of the present embodiment are not implemented. Comparative examples 1 and 2 show results obtained for cases of ionizers in which the symmetrical arrangement of the AC high voltage power source 72 and the 180° phase difference between the voltage A and the voltage B are not applied. In this case, noise due to induced charge is superimposed on the potential amplitude, whereby the ion balance (potential amplitude) increases. As a result, even if the potential amplitude actually is of a substantial zero level, a concern exists in that it may be mistakenly recognized that ion balance has not been achieved.

Comparative examples 1 and 2 show respective cases in which noises of different polarities are superimposed on the potential amplitude. Further, even in a case in which positive ions 18 and negative ions 20 are generated alternately in a pulsed manner, and the positive ions 18 and the negative ions 20 are made to reach the workpiece 16 alternately, since the positive ions 18 and the negative ions 20 do not arrive at the workpiece 16 within the same time band, the same result of comparative examples 1 and 2 is brought about due to the arrival periods of the positive ions 18 and the negative ions 20 on the workpiece 16.

The ionizer 10 according to the present invention is constructed basically as described above. Next, operations and advantages of the ionizer 10 shall be explained in comparison with a conventional technique.

FIGS. 13A through 17 show certain problems that occur with a conventional ionizer (i.e., an ionizer in which the countermeasures of the present embodiment are not implemented). In the following explanation, the reference numerals of the constitutional elements of the ionizer 10 according to the present embodiment as described in FIGS. 1 to 12 are used if necessary.

As explained in the Summary of the Invention section, when positive ions 18 and negative ions 20 are generated alternately in a pulsed manner, the positive ions 18 and the negative ions 20 arrive at the workpiece 16 alternately, leading to an increase in potential amplitude at the workpiece 16 due to the arrival periods of the positive ions 18 and the negative ions 20 on the workpiece 16. Further, induced charge due to the power sources that apply the AC high voltage to the needle electrodes 44 (44*a* to 44*e*), or due to the wires connected electrically between the power sources and the needle electrodes 44 (44*a* to 44*e*) become a cause of noise at the workpiece 16, whereby the potential amplitude at the workpiece 16 increases.

Figure 13B:
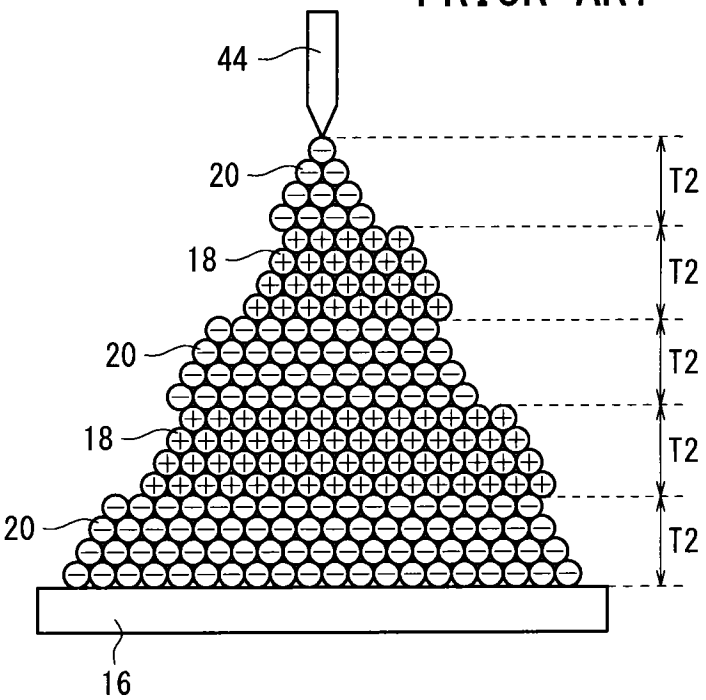
FIG. 13B PRIOR ART
FIGS. 13A and 13B are explanatory drawings showing schematically the release of ions from the ionizer.
Figure 13A:
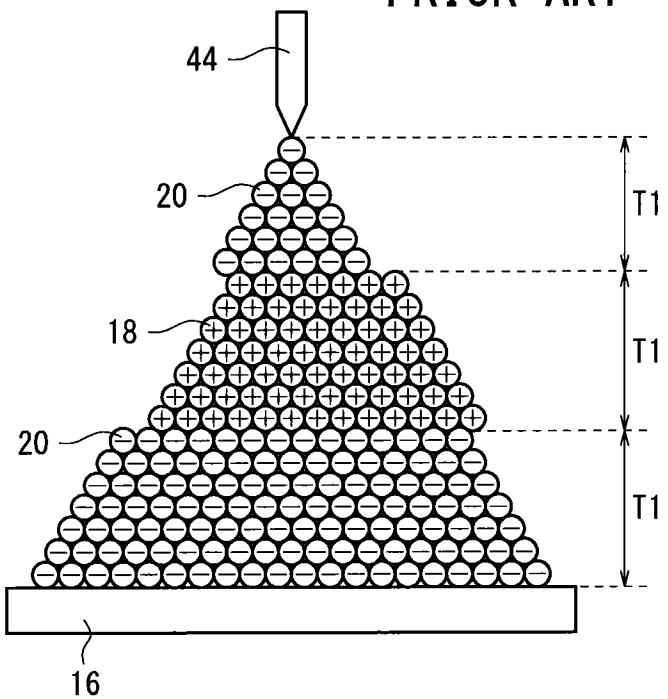
FIG. 13A PRIOR ART

FIGS. 13A and 13B are drawings illustrating problems that occur in the case that the frequency of the AC high voltage applied to the needle electrodes 44 is changed.

FIG. 13A is an explanatory drawing showing the release of positive ions 18 or negative ions 20 from the needle electrodes 44 for a case in which the frequency of the AC high voltage is low. FIG. 13B is an explanatory drawing showing the release of positive ions 18 or negative ions 20 from the needle electrodes 44 for a case in which the frequency of the AC high voltage is high.

In the case of FIG. 13A, the time T1 for the positive portion and the negative portion of the AC high voltage is long. Therefore, the generated quantity of positive ions 18 and negative ions 20 increases, and the quantity of ions that reach the workpiece 16 can be increased. However, accompanying such an increase in generated quantity, since the quantity of positive ions 18 and negative ions 20 that cancel each other out and cease to exist is small, the potential amplitude detected by the surface potential sensor 24 becomes large. Stated otherwise, because the positive ions 18 and the negative ions 20 do not arrive at the workpiece 16 in the same time band, there are fewer opportunities for the positive ions 18 and the negative ions 20 to cancel each other out. As a result, potential amplitude at the workpiece 16 increases due to the arrival periods of the positive ions 18 and the negative ions 20 on the workpiece 16.

In the case of FIG. 13B, the time T2 for the positive portion and the negative portion of the AC high voltage is short. Therefore, the generation periods for the positive ions 18 and the negative ions 20 are short, and the generated quantity of positive ions 18 and negative ions 20 becomes reduced. As a result, the arrival periods of the positive ions 18 and the negative ions 20 are shortened, and the quantity of ions arriving at the workpiece 16 becomes smaller. Thus, the potential amplitude detected by the surface potential sensor 24 can be made smaller. However, because the generated quantity of positive ions 18 and negative ions 20 per unit time, or the quantity of ions that reach the workpiece 16 is small, time is required for removal of charge from the workpiece 16, and the charge removal speed decreases. As a result, the charge removal capability of the ionizer becomes deteriorated.

Figure 14:
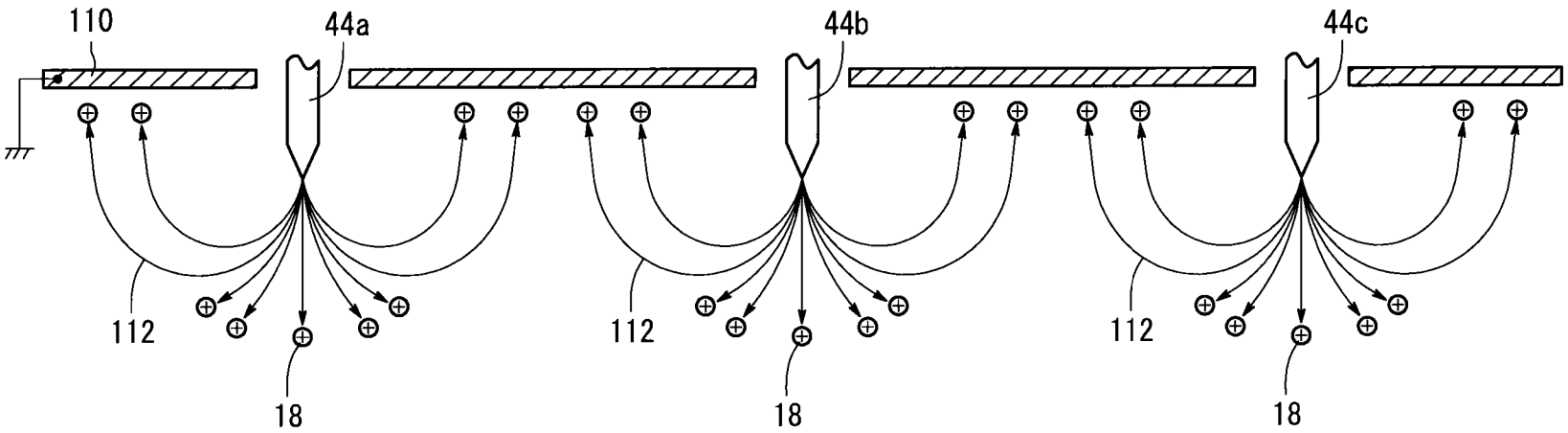
FIG. 14 PRIOR ART
FIG. 14 is an explanatory drawing in which release of ions from the ionizer is shown schematically.

FIG. 14 is a drawing for explaining a problem that occurs in the case that at least the workpiece 16 side of the ionizer is shielded by a shield electrode 110, in which the needle electrodes 44*a* to 44*c* are exposed to the workpiece 16 through holes formed in the shield electrode 110. Such a structure is adopted in the ionizers disclosed in U.S. Pat. No. 6,693,788 and International Publication No. WO 2007/122742.

In this case, since the workpiece 16 side of the ionizer is shielded by the shield electrode 110, the influence of induced charge and noise on potential amplitude due to the power sources and wiring arrangement in the interior of the ionizer can be eliminated. However, when a high voltage is applied to the needle electrodes 44*a* to 44*c*, lines of electric force 112 are formed between the shield electrode 110 and the distal ends of the needle electrodes 44*a* to 44*c*, and positive ions are absorbed along the lines of electric force 112. As a result, the quantity of positive ions 18 that reach the workpiece 16 is reduced, the charge removal speed is lowered, and the charge removal capability of the ionizer is deteriorated.

FIG. 14 shows a case in which positive ions 18 are generated in the vicinity of the needle electrodes 44*a* to 44*c* by application of a positive high voltage simultaneously to the needle electrodes 44*a* to 44*c*. It is a matter of course that similar problems would occur if a negative high voltage were applied simultaneously to the needle electrodes 44*a* to 44*c* for thereby generating negative ions 20.

Figure 15:
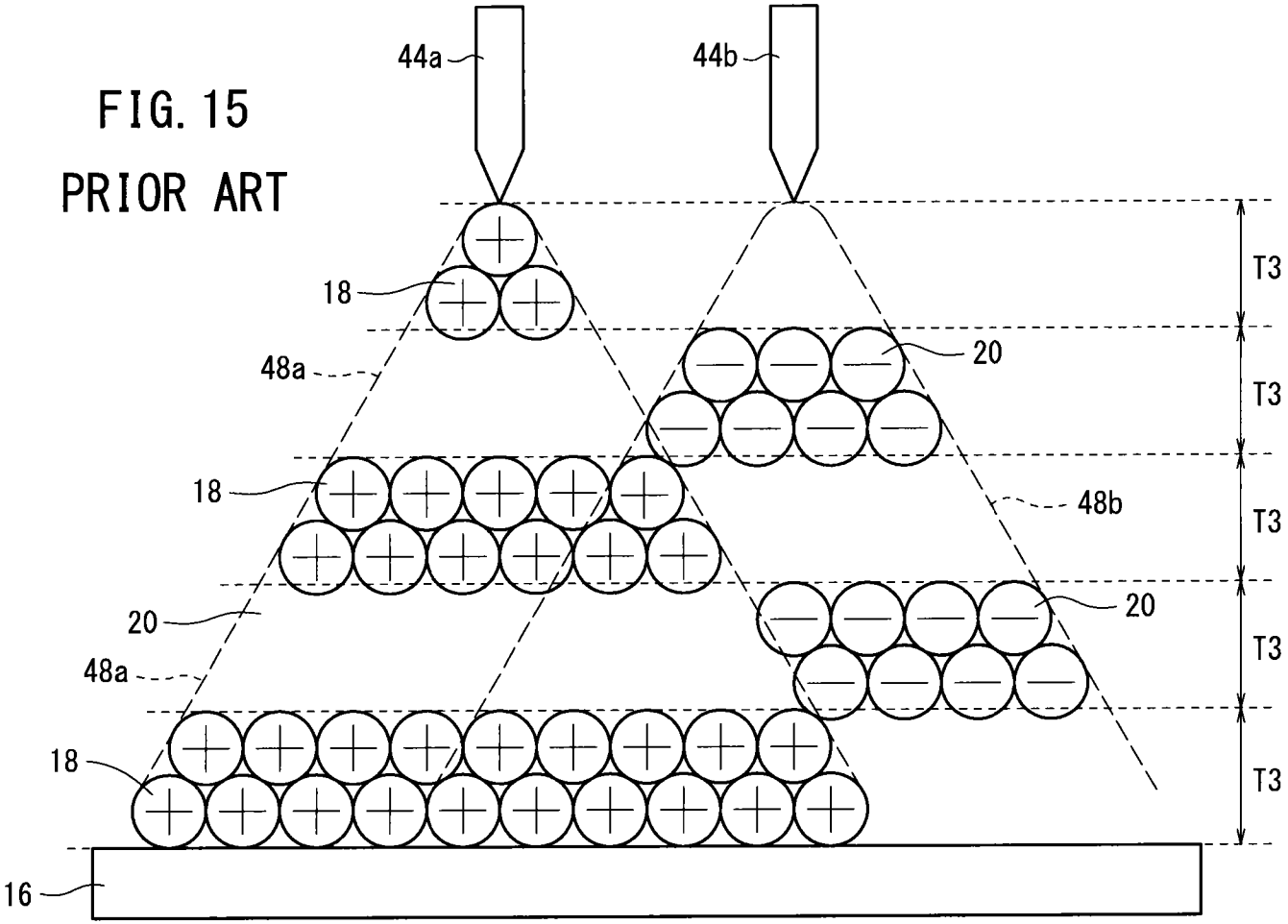
FIG. 15 PRIOR ART
FIG. 15 is an explanatory drawing in which release of ions from the ionizer is shown schematically.

FIG. 15 is a drawing for explaining problems that occur in the case that application of a positive high voltage to one needle electrode 44*a* and application of a negative high voltage to another needle electrode 44*b* are performed alternately. More specifically, as shown in FIG. 15, generation of positive ions 18 by application of the positive high voltage to the needle electrode 44*a* during time periods T3, and generation of negative ions 20 by application of the negative high voltage to the needle electrode 44*b* during other time periods T3 thereafter are repeatedly carried out in an alternating manner.

In this case, at regions between the needle electrodes 44*a*, 44*b* in the vicinity of the workpiece 16 in the charge removal spaces 48*a*, 48*b*, both positive ions 18 and negative ions 20 arrive at the workpiece 16 in the same time band. Thus, the positive ions 18 and the negative ions 20 intermix to achieve ion balance, whereby removal of charge with respect to the workpiece 16 can be carried out. More specifically, the potential amplitude detected by the surface potential sensor 24 is small. However, at the end of the charge removal space 48*a* where only positive ions 18 exist, or at the end of the charge removal space 48*b* where only negative ions 20 exist, since only one type of ions reach the workpiece 16, ion balance cannot be achieved and the potential amplitude increases. As a result, the region where removal of charge from the workpiece 16 can actually be performed is limited.

Figure 16:
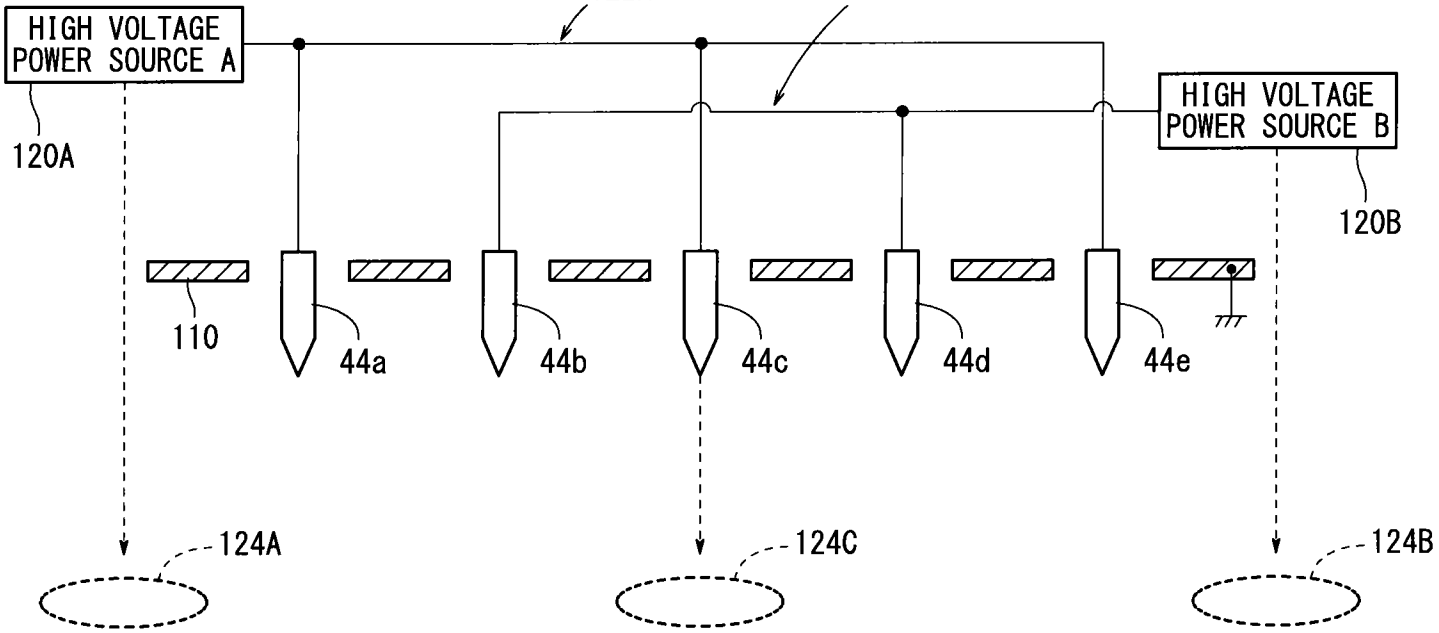
FIG. 16 PRIOR ART
FIG. 16 is an explanatory drawing showing schematically the structure of the ionizer of International Publication No. WO 2007/122742.
Figure 17:
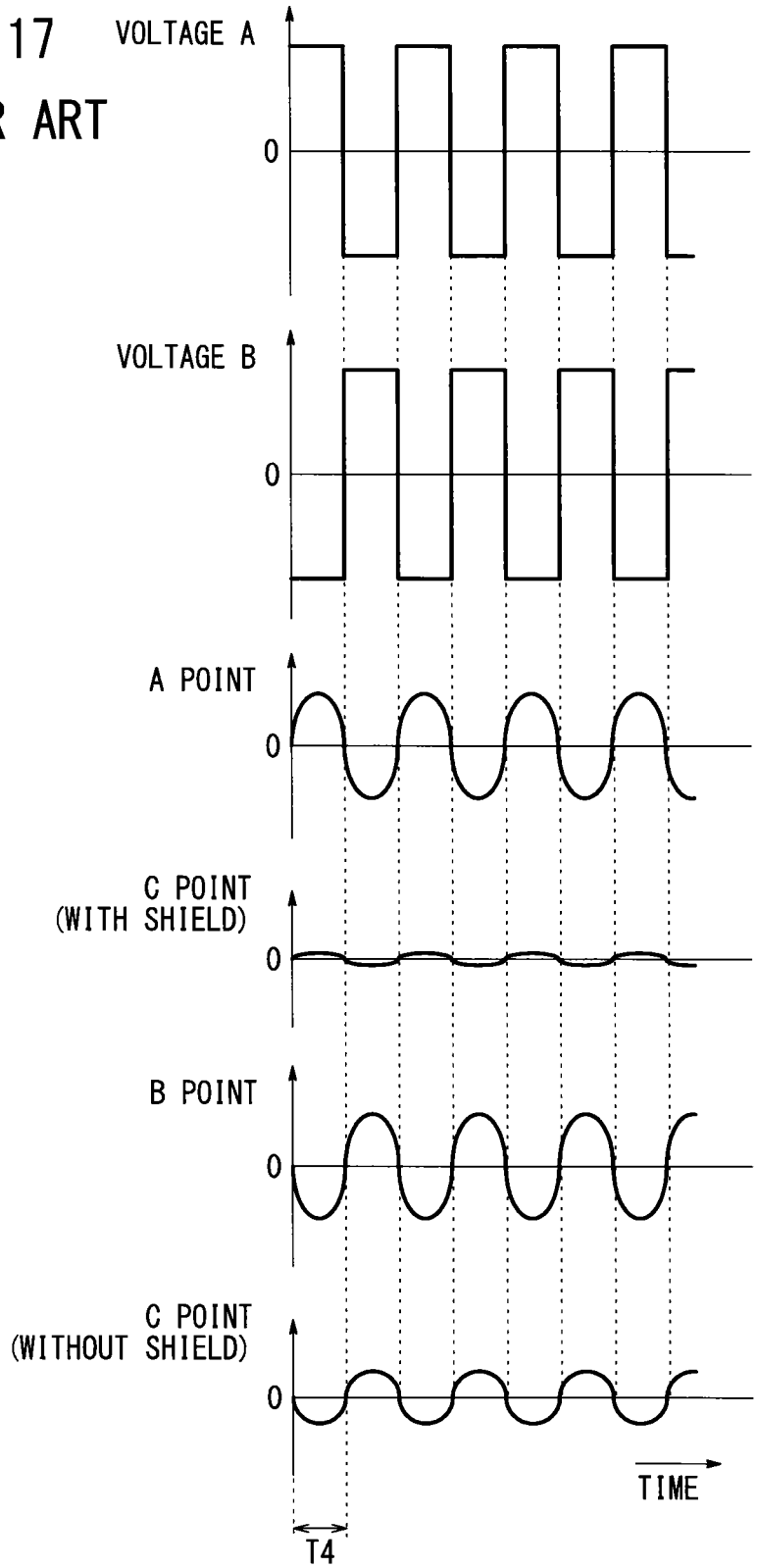
FIG. 17 PRIOR ART
FIG. 17 is a time chart for explaining the relationship between AC voltage applied to the needle electrodes and potentials detected at points A through C, in the ionizer of FIG. 16.

FIGS. 16 and 17 are drawings for explaining problems that occur in a case in which at least the workpiece 16 side of the ionizer is shielded by a shield electrode 110, needle electrodes 44*a* to 44*e* are exposed respectively to the workpiece 16 from plural holes of the shield electrode 110, and an AC high voltage (voltage A) is applied to the odd numbered needle electrodes 44*a*, 44*c*, 44*e*, whereas an AC high voltage (voltage B), which is 180° out of phase with the voltage A, is applied to the even numbered needle electrodes 44*b*, 44*d*. Such a structure is adopted in the ionizer disclosed in International Publication No. WO 2007/122742.

In this case, a high voltage power source 120A is connected electrically to the odd numbered needle electrodes 44*a*, 44*c*, 44*e* through wires 122A, and another high voltage power source 120B is connected electrically to the even numbered needle electrodes 44*b*, 44*d* through wires 122B. Further, the high voltage power sources 120A, 120B are not shielded by the shield electrode 110, and the wires 122A and the wires 122B are not arranged symmetrically or in mutually confronting positions. More specifically, the high voltage power sources 120A, 120B are disposed outside of the ionizer, or alternatively, even if disposed in the interior of the ionizer, the high voltage power sources 120A, 120B are in a state of not being shielded by the shield electrode 110. Further, the wires 122B are disposed more toward the side of (i.e., closer in proximity to) the needle electrodes 44*a* to 44*e* than the wires 122A.

The surface potential sensor 24 is described as being capable of detecting potentials at an A point 124A, a B point 124B and a C point 124C in the vicinity of the surface of the workpiece 16. Moreover, the A point 124A is located directly beneath the high voltage power source 120A, the B point 124B is located directly beneath the high voltage power source 120B, and the C point 124C is located directly beneath the needle electrode 44*c*.

In the case that the voltage A is applied to the odd numbered needle electrodes 44*a*, 44*c*, 44*e*, and the voltage B is applied to the even numbered needle electrodes 44*b*, 44*d*, the surface potential sensor 24 detects respective potential amplitudes, as shown in FIG. 17, at the A point 124A, the B point 124B, and the C point 124C.

In this case, at the A point 124A directly beneath the high voltage power source 120A, a large potential amplitude is detected corresponding to the timewise change in the voltage A, as a result of induced charge and noise caused by the high voltage power source 120A. Further, at the B point 124B directly beneath the high voltage power source 120B, a large potential amplitude is detected corresponding to the timewise change in the voltage B, as a result of induced charge and noise caused by the high voltage power source 120B.

At the C point 124C directly beneath the needle electrode 44*c*, due to the fact that the C point 124C is separated from the high voltage power sources 120A, 120B, and owing to the shielding effect of the shield electrode 110, induced charge and noise caused by the high voltage power sources 120A, 120B, or the influence of induced charge and noise caused by the wires 122A, 122B on the potential amplitude of the surface potential sensor 24 is suppressed, whereby the potential amplitude can be kept small. However, as explained in relation to FIG. 14, when the shield electrode 110 is provided, the quantity of positive ions 18 and negative ions 20 that reach the workpiece 16 is reduced, and therefore, the charge removal speed is lowered, and the charge removal capability of the ionizer decreases.

On the other hand, in the case that the shield electrode 110 is not provided, the potential amplitude becomes large as a result of induced charge and noise due to the wires 122A, 122B, and in particular, as a result of induced charge and noise due to the wires 122B.

In the foregoing manner, in the case of FIGS. 16 and 17, the potential amplitude becomes large due to the aforementioned induced charge and noise. As a countermeasure to such induced charge and noise, a means of protection from the AC high voltage must be separately provided. In this case, the high voltage power sources 120A, 120B are constructed separately from the ionizer, and are distanced insofar as possible from the workpiece 16, or alternatively, the high voltage power sources 120A, 120B and the wires 122A, 122B are shielded by the shield electrode 110. However, in this case, there is no choice but to tolerate the generated quantity of positive ions 18 and negative ions 20 becoming decreased, or to accept a reduction in the quantity of positive ions 18 and negative ions 20 that reach the workpiece 16.

In contrast thereto, as noted previously, the ionizer 10 according to the present embodiment includes at least two needle electrodes 44 (44*a* to 44*e*), the first high voltage power source 70A for applying a voltage A (AC high voltage) to one of the needle electrodes 44*a*, 44*c*, 44*e*, the second high voltage power source 70B for applying a voltage B (AC high voltage) of different polarity than the voltage A to the other needle electrodes 44*b*, 44*d*, the first wiring arrangement 74A electrically connecting the first high voltage power source 70A and the needle electrodes 44*a*, 44*c*, 44*e*, and the second wiring arrangement 74B electrically connecting the second high voltage power source 70B and the needle electrodes 44*b*, 44*d*.

In this case, the voltage A is applied from the first high voltage power source 70A to the needle electrodes 44*a*, 44*c*, 44*e* via the first wiring arrangement 74A, and the voltage B is applied from the second high voltage power source 70B to the needle electrodes 44*b*, 44*d* via the second wiring arrangement 74B, so that ions (positive ions 18 or negative ions 20) are generated in the vicinity of the needle electrodes 44*a*, 44*c*, 44*e*, and ions (negative ions 20 or positive ions 18) which differ in polarity from the aforementioned ions, are generated in the vicinity of the needle electrodes 44*b*, 44*d*. Therefore, by release of the generated positive ions 18 and negative ions 20 toward the workpiece 16, the ionizer 10 can neutralize and eliminate electrical charge that charges the workpiece 16.

Further, as described in the Summary of the Invention section above, with the conventional electric charge generating device, by generating the positive ions 18 and the negative ions 20 alternately in a pulsed manner, the positive ions 18 and the negative ions 20 arrive at the workpiece 16 alternately, leading to an increase in potential amplitude at the workpiece 16 due to the arrival periods of the positive ions 18 and the negative ions 20 on the workpiece 16. Further, induced charge caused at the workpiece 16 due to the power sources that apply the AC voltage to the needle electrodes 44, or due to the wires connected electrically between the power sources and the needle electrodes 44, becomes a cause of noise. Thus, the potential amplitude at the workpiece 16 becomes greater than the actual value, and noise cannot effectively be eliminated.

Thus, with the ionizer 10 according to the present embodiment, in order to overcome the aforementioned problems, and to achieve the object eliminating the influence of noise due to the power sources and the wiring arrangements, the first high voltage power source 70A and the second high voltage power source 70B are positioned in confronting relation to each other, and the first wiring arrangement 74A and the second wiring arrangement 74B also are positioned in confronting relation to each other.

As described above, the voltage A applied from the first high voltage power source 70A to the needle electrodes 44*a*, 44*c*, 44*e* via the first wiring arrangement 74A, and the voltage B applied from the second high voltage power source 70B to the needle electrodes 44*b*, 44*d* via the second wiring arrangement 74B are of mutually different polarities. Owing thereto, the induced charge and noise caused by the first high voltage power source 70A, and the induced charge and noise caused by the second high voltage power source 70B are developed respectively with mutually different polarities. Accordingly, such induced charges and noises cancel each other out mutually, and each of the induced charges and each of such noises can effectively be eliminated.

In this manner, by disposing the first high voltage power source 70A and the second high voltage power source 70B in confronting relation to each other, and by disposing the first wiring arrangement 74A and the second wiring arrangement 74B in confronting relation to each other, the influence of induced charge and noise caused by the first high voltage power source 70A and the second high voltage power source 70B, or the influence of induced charge and noise caused by the first wiring arrangement 74A and the second wiring arrangement 74B on potential amplitude can be eliminated. As a result, with the present embodiment, the first high voltage power source 70A, the second high voltage power source 70B, the first wiring arrangement 74A, and the second wiring arrangement 74B can be constructed together integrally with the respective needle electrodes 44*a* to 44*e*, and it becomes unnecessary to provide any type of shielding countermeasure with respect to the first high voltage power source 70A, the second high voltage power source 70B, the first wiring arrangement 74A, and the second wiring arrangement 74B.

More specifically, with the ionizer 10 according to the present embodiment, the respective needle electrodes 44*a* to 44*e* are exposed on the bottom surface of the housing 22, which is made from an electrically insulating material, through the electrode cartridges 46*a* to 46*e*, which are made from an electrically insulating material, and the first high voltage power source 70A and the second high voltage power source 70B, and the first wiring arrangement 74A and the second wiring arrangement 74B can be disposed inside of the housing 22.

As a result, the ionizer 10 can be used in a condition in which the ionizer 10 is placed in close proximity to the workpiece 16. Further, since a shielding countermeasure is rendered unnecessary, positive ions 18 and negative ions 20 are not absorbed by the shield. As a result, the quantity of positive and negative ions 18, 20 that reach the surface of the workpiece 16 can be increased. In this manner, in a case that the ionizer 10 is placed in proximity to the workpiece 16 and positive ions 18 and negative ions 20 are generated thereby, the charge removal speed with respect to the workpiece 16 can be enhanced, together with increasing the charge removal capability of the ionizer 10.

In particular, if the ionizer 10 and the workpiece 16 are placed in close proximity, and an AC high voltage having a low frequency of 100 Hz or less is applied to the needle electrodes 44*a* to 44*e*, then since positive ions 18 and negative ions 20 can be generated reliably, the charge removal speed can further be enhanced.

Furthermore, since the first high voltage power source 70A, the second high voltage power source 70B, the first wiring arrangement 74A, and the second wiring arrangement 74B are disposed inside of the housing 22, ease of use of the ionizer 10 can be enhanced.

Further, with the ionizer 10, since the needle electrodes 44*a*, 44*c*, 44*e* to which the voltage A is applied from the first high voltage power source 70A, and the needle electrodes 44*b*, 44*d* to which the voltage B is applied from the second high voltage power source 70B are arranged alternately along the A direction, a bar type of ionizer 10 can easily be constructed. Further, by arranging the needle electrodes 44*a* to 44*e* alternately in this manner, positive ions 18 and negative ions 20 can be evenly distributed in the charge removal spaces 48*a* to 48*e* between the ionizer 10 and the workpiece 16, uniform charge removal without unevenness can be carried out, and the charge removing capability can be further enhanced. Further, an increase in potential amplitude at the workpiece 16 due to the arrival periods of the positive ions 18 and the negative ions 20 at the workpiece 16 can be suppressed.

Further, as shown in FIGS. 6 through 7B, all of the needle electrodes 44*a* to 44*e* are arranged on the axis C1 between the first high voltage power source 70A and the first wiring arrangement 74A, and the second high voltage power source 70B and the second wiring arrangement 74B, and together therewith, one set of needle electrodes 44*a*, 44*c*, 44*e* and the other set of needle electrodes 44*b*, 44*d* are arranged alternately on the axis C2 along the A direction. Thus, the first high voltage power source 70A and the second high voltage power source 70B, and the first wiring arrangement 74A and the second wiring arrangement 74B are arranged symmetrically about the axes C1, C2. Consequently, induced charge and noise caused by the first high voltage power source 70A and induced charge and noise caused by the second high voltage power source 70B cancel each other out, and together therewith, induced charge and noise caused by the first wiring arrangement 74A and induced charge and noise caused by the second wiring arrangement 74B cancel each other out. As a result, the influence of induced charge and noise on potential amplitude can effectively be eliminated. Further, an increase in potential amplitude due to the arrival periods of the positive ions and the negative ions at the workpiece 16 can effectively be suppressed.

With the needle electrodes 44*a* to 44*e*, because the distal ends thereof are exposed to the exterior, due to the electric field concentration at the distal ends, positive ions 18 and negative ions 20 can easily be generated, whereby it is possible to increase the charge removal capability of the ionizer 10.

Further, in the ionizer 10, the first high voltage power source 70A and the second high voltage power source 70B are disposed substantially in parallel with respect to the workpiece 16, and the first wiring arrangement 74A and the second wiring arrangement 74B are disposed substantially in parallel with respect to the workpiece 16. Consequently, induced charge and noise caused by the first high voltage power source 70A and induced charge and noise caused by the second high voltage power source 70B cancel each other out effectively, while in addition, induced charge and noise caused by the first wiring arrangement 74A and induced charge and noise caused by the second wiring arrangement 74B cancel each other out effectively. As a result, the actual potential amplitude in the vicinity of the surface of the workpiece 16 can be reduced.

The first high voltage power source 70A and the second high voltage power source 70B are disposed substantially in parallel with respect to the workpiece 16 at locations of substantially the same distance from the workpiece 16, and the first wiring arrangement 74A and the second wiring arrangement 74B are disposed substantially in parallel with respect to the workpiece 16 at locations of substantially the same distance from the workpiece 16. Consequently, since each of the aforementioned induced charges and each of the noises discussed above can reliably be cancelled out, the actual potential amplitude can be further reduced.

Further, since the voltage B is an AC high voltage that is 180° out of phase with the voltage A, by application of the voltage A from the first high voltage power source 70A to the needle electrodes 44*a*, 44*c*, 44*e* via the first wiring arrangement 74A, and by application of the voltage B from the second high voltage power source 70B to the needle electrodes 44*b*, 44*d* via the second wiring arrangement 74B, generation of positive ions 18 in the vicinity of the needle electrodes 44*a*, 44*c*, 44*e* together with generation of negative ions 20 in the vicinity of the needle electrodes 44*b*, 44*d*, and generation of negative ions 20 in the vicinity of the needle electrodes 44*a*, 44*c*, 44*e* together with generation of positive ions 18 in the vicinity of the needle electrodes 44*b*, 44*d* are carried out alternately. As a result, in the charge removal spaces 48*a* to 48*e*, positive ions 18 and negative ions 20 are distributed uniformly, and uniform removal of charge without unevenness can be carried out. Further, an increase in potential amplitude caused by the arrival periods of the positive ions 18 and the negative ions 20 at the workpiece 16 can be suppressed.

In addition, the first circuit board 78A of the first high voltage power source 70A, and the second circuit board 78B of the second high voltage power source 70B are disposed upright and mutually in parallel with respect to the workpiece 16. Therefore, the aforementioned induced charge and noise can reliably be cancelled, and the actual potential amplitude can be further reduced.

The first positive voltage generator 82A disposed on the first circuit board 78A and the second negative voltage generator 86B disposed on the second circuit board 78B confront each other, and the first negative voltage generator 86A disposed on the first circuit board 78A and the second positive voltage generator 82B disposed on the second circuit board 78B confront each other. More specifically, two voltage generators having the same structure are prepared, and if one of the voltage generators is disposed in confronting relation to the other voltage generator in a state of being rotated by 180° with respect thereto, the aforementioned structure can be realized. As a result, an advantage can easily be obtained in which the above-described induced charge and noise are reduced.

Since the DC power source 76 is disposed between a central portion of the first circuit board 78A and a central portion of the second circuit board 78B, the first high voltage power source 70A and the second high voltage power source 70B can be arranged symmetrically about the DC power source 76. As a result, the effect of reducing the aforementioned induced charge and noise can easily be obtained, and manufacturability (mass production) of the ionizer 10 can further be enhanced.

Furthermore, the inverter circuits 80A, 80B, 84A, 84B are arranged on the first circuit board 78A and on the second circuit board 78B. Owing thereto, the DC voltage supplied from the exterior is adjusted into the power source voltage and output from the DC power source 76, and is converted from the DC voltage (power source) into an AC high voltage of a desired frequency by the inverter circuits 80A, 80B, 84A, 84B, whereby the voltage A and the voltage B can be generated from the first positive voltage generator 82A, the second positive voltage generator 82B, the first negative voltage generator 86A, and the second negative voltage generator 86B.

Still further, as noted previously, the first wiring arrangement 74A and the second wiring arrangement 74B are of substantially the same structure and are disposed in confronting relation symmetrically with respect to the axes C1, C2. In this case, the first wiring arrangement 74A comprises the extraction lines 88A, 90A, the first supply line 92A extending in the A direction, and the distribution lines 94*a*, 94*c*, 94*e*, while the second wiring arrangement 74B comprises the extraction lines 88B, 90B, the second supply line 92B extending in the A direction, and the distribution lines 94*b*, 94*d*. According to such a structure, induced charge and noise caused by the first wiring arrangement 74A and induced charge and noise caused by the second wiring arrangement 74B can effectively cancel each other out.

Additionally, the extraction line 88A and the extraction line 90B are arranged in confronting relation to each other, and the extraction line 90A and the extraction line 88B are arranged in confronting relation to each other. Furthermore, the first supply line 92A and the second supply line 92B are arranged in confronting relation to each other. Owing thereto, induced charge and noise caused by the first wiring arrangement 74A and induced charge and noise caused by the second wiring arrangement 74B can reliably cancel each other out.

In relation to the present embodiment, a case has been described in which the needle electrodes 44*a* to 44*e* are arranged at predetermined intervals in series along the A direction. However, as long as the aforementioned positional relationships can be maintained, the arrangement of the respective needle electrodes 44*a* to 44*e* can be varied appropriately.

Figure 18A:
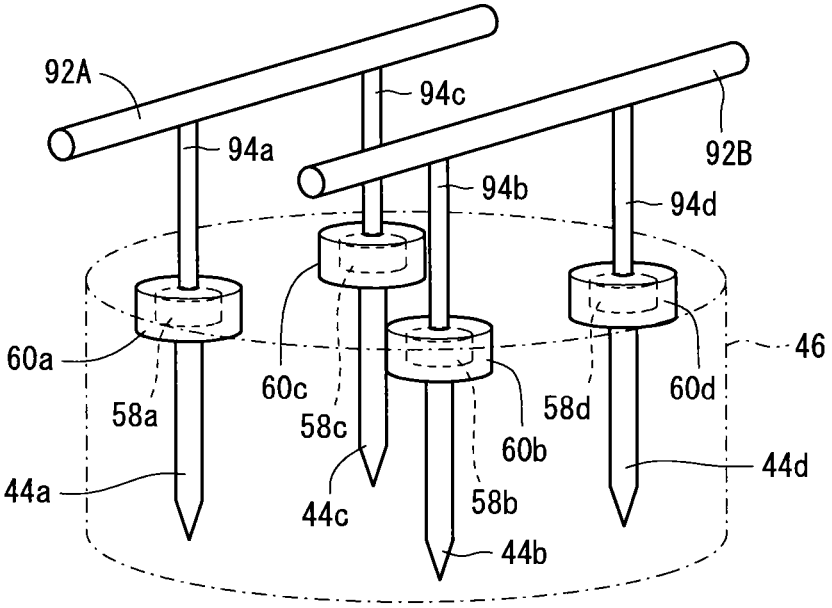
FIG. 18A is a perspective view of main parts illustrating another arrangement of needle electrodes in the ionizer of FIG. 1.
Figure 18B:
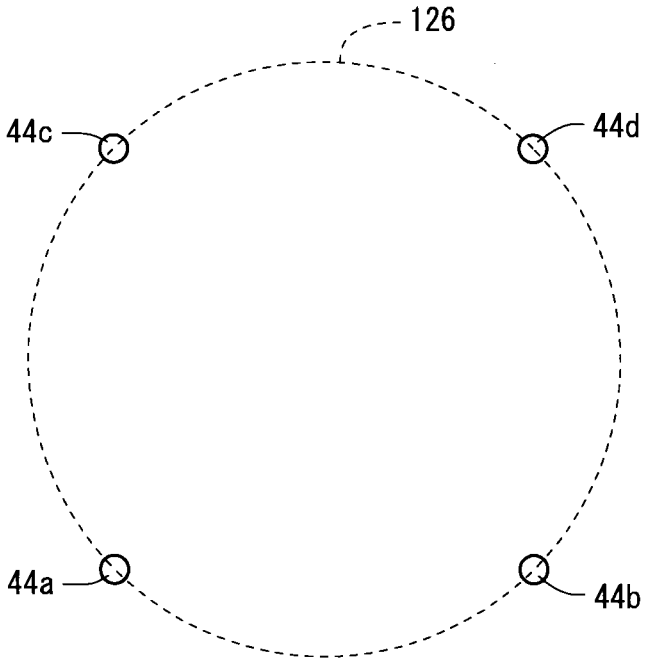
FIG. 18B is a plan view of main parts showing the arrangement of the needle electrodes of FIG. 18A.

More specifically, as shown in FIGS. 18A and 18B, for example, four needle electrodes 44*a* to 44*d* may be provided in one electrode cartridge 46.

In this case, in FIG. 18B, the four needle electrodes 44*a* to 44*d* are disposed on a virtual circle 126 as viewed in plan. Further, as viewed in plan, if the respective needle electrodes 44*a* to 44*d* are disposed at intervals of 90°, as shown in FIG. 18A, distribution lines 94*a*, 94*c* can be suspended from a first supply line 92A and connected to the receiving openings 60*a*, 60*c*, and distribution lines 94*b*, 94*d* can be suspended from a second supply line 92B and connected to the receiving openings 60*b*, 60*d*. As a result, the first high voltage power source 70A and the first wiring arrangement 74A, and the second high voltage power source 70B and the second wiring arrangement 74B can be disposed in point symmetry with respect to the (center of the) virtual circle 126.

Consequently, induced charge and noise caused by the first high voltage power source 70A and induced charge and noise caused by the second high voltage power source 70B can effectively cancel each other out, and at the same time, induced charge and noise caused by the first wiring arrangement 74A and induced charge and noise caused by the second wiring arrangement 74B can effectively cancel each other out. In this case as well, an increase in potential amplitude due to the arrival periods of the positive ions 18 and the negative ions 20 at the workpiece 16 can effectively be suppressed.

Further, in the foregoing description, a case has been explained in which, inside the housing 22 of the ionizer 10, there are disposed the first high voltage power source 70A, the second high voltage power source 70B, the first wiring arrangement 74A, and the second wiring arrangement 74B. Assuming that the first high voltage power source 70A, the second high voltage power source 70B, the first wiring arrangement 74A, and the second wiring arrangement 74B are arranged symmetrically and substantially in parallel, since the advantage can be obtained in which induced charge and noise are reduced, insofar as such a positional relationship can be maintained, the first high voltage power source 70A and the second high voltage power source 70B can be disposed outside of the housing 22, or alternatively, the first high voltage power source 70A, the second high voltage power source 70B, the first wiring arrangement 74A, and the second wiring arrangement 74B can all be disposed outside of the housing 22. In such cases, although it is necessary to provide some countermeasure to protect the user from the AC high voltage, the object of the present embodiment to eliminate induced charge and noise can still be achieved.

In the foregoing description, an ionizer 10 has been described as one type of charge generating device, however, the present embodiment is not limited to this description. In the ionizer 10, if the same AC high voltages are applied to the respective needle electrodes 44*a* to 44*e* such that positive ions 18 or negative ions 20 are generated concurrently in the vicinity of the needle electrodes 44*a* to 44*e*, then either one of positive ions 18 or negative ions 20 can be released toward the workpiece 16, such that the device can be made to function as an electrifying device for electrifying the workpiece 16. More specifically, since the ionizer 10 and the electrifying device are the same insofar as being capable of releasing positive ions 18 or negative ions 20 toward the workpiece 16, it is possible for the ionizer 10 according to the present embodiment also to be used as an electrifying device.

If the ionizer 10 functions as an electrifying device in this manner, in such an electrifying device as well, the aforementioned effects of reducing induced charge and noise can easily be obtained. It also goes without saying that, even if the electrifying device comprising the structure of the ionizer 10 is manufactured separately, the aforementioned effects of reducing induced charge and noise can easily be obtained.

The electric charge generating device according to the present invention is not limited to the aforementioned embodiment, and it is a matter of course that various additional or modified structures may be adopted therein without deviating from the essential gist of the present invention.

What is claimed is:

1. An electric charge generating device comprising:

at least two electrodes;

a first power source for applying a first voltage to one first electrode;

a second power source for applying a second voltage of different polarity than the first voltage to another second electrode;

a first wiring arrangement electrically connecting the first power source and the first electrode; and a second wiring arrangement electrically connecting the second power source and the second electrode;

a housing made from an electrically insulating material;

wherein the first electrode and the second electrode are exposed on a surface of the housing;

wherein the first power source and the second power source are disposed inside the housing, and/or the first wiring arrangement and the second wiring arrangement are disposed inside the housing;

wherein the first power source and the second power source are disposed in confronting relation to each other, and/or the first wiring arrangement and the second wiring arrangement are disposed in confronting relation to each other; and wherein the first voltage is applied from the first power source to the first electrode via the first wiring arrangement, and the second voltage is applied from the second power source to the second electrode via the second wiring arrangement, whereby ions are generated in the vicinity of the first electrode, and ions, which differ in polarity from the aforementioned ions, are generated in the vicinity of the second electrode;

wherein the electric charge generating device releases ions generated in the vicinity of the first electrode, and ions generated in the vicinity of the second electrode toward a target object;

wherein the first power source and the second power source are disposed substantially in parallel with respect to the target object, and/or the first wiring arrangement and the second wiring arrangement are disposed substantially in parallel with respect to the target object;

wherein the first power source and the second power source are disposed substantially in parallel with respect to the target object at locations of substantially the same distance from the target object, and/or the first wiring arrangement and the second wiring arrangement are disposed substantially in parallel with respect to the target object at locations of substantially the same distance from the target object;

wherein the first power source generates a first AC voltage, and the second power source generates a second AC voltage, which is 180° out of phase with the first AC voltage;

wherein by application of the first AC voltage from the first power source to the first electrode via the first wiring arrangement, and application of the second AC voltage from the second power source to the second electrode via the second wiring arrangement, generation of positive ions in the vicinity of the first electrode together with generation of negative ions in the vicinity of the second electrode, and generation of negative ions in the vicinity of the first electrode together with generation of positive ions in the vicinity of the second electrode are carried out alternately;

wherein the first power source comprises a first circuit board, a first positive voltage generator disposed on the first circuit board and which generates a positive voltage of the first AC voltage, and a first negative voltage generator disposed on the first circuit board and which generates a negative voltage of the first AC voltage;

wherein the second power source comprises a second circuit board, a second positive voltage generator disposed on the second circuit board and which generates a positive voltage of the second AC voltage, and a second negative voltage generator disposed on the second circuit board and which generates a negative voltage of the second AC voltage; and wherein the first circuit board and the second circuit board are disposed upright and mutually in parallel with respect to the target object.

2. The electric charge generating device according to claim 1, wherein the first positive voltage generator and the second negative voltage generator confront each other, and the first negative voltage generator and the second positive voltage generator confront each other.

3. The electric charge generating device according to claim 2, wherein:

a voltage supply source for supplying a power source voltage to the first positive voltage generator, the first negative voltage generator, the second positive voltage generator, and the second negative voltage generator is disposed between a central portion of the first circuit board and a central portion of the second circuit board;

the first positive voltage generator, the voltage supply source, and the first negative voltage generator are arranged in this order on the first circuit board substantially in parallel with respect to the target object; and the second negative voltage generator, the voltage supply source, and the second positive voltage generator are arranged in this order on the second circuit board substantially in parallel with respect to the target object.

4. The electric charge generating device according to claim 3, wherein:

the voltage supply source is a DC power source which generates a DC voltage by supply of power thereto from the exterior;

inverter circuits for converting the DC voltage into an AC voltage are disposed respectively on the first circuit board at a location between the DC power source and the first positive voltage generator, on the first circuit board at a location between the DC power source and the first negative voltage generator, on the second circuit board at a location between the DC power source and the second positive voltage generator, and on the second circuit board at a location between the DC power source and the second negative voltage generator;

the first positive voltage generator generates a positive voltage of the first AC voltage by extracting only a positive portion of the AC voltage after conversion thereof, and amplifying the extracted positive portion;

the first negative voltage generator generates a negative voltage of the first AC voltage by extracting only a negative portion of the AC voltage after conversion thereof, and amplifying the extracted negative portion;

the second positive voltage generator generates a positive voltage of the second AC voltage by extracting only a positive portion of the AC voltage after conversion thereof, and amplifying the extracted positive portion; and the second negative voltage generator generates a negative voltage of the second AC voltage by extracting only a negative portion of the AC voltage after conversion thereof, and amplifying the extracted negative portion.

5. The electric charge generating device according to claim 1, wherein:

the first wiring arrangement comprises a first extraction line for extracting the first voltage generated by the first power source, a first supply line connected to the first extraction line and extending substantially in parallel with respect to the target object, and a first distribution line connected to the first supply line and connected electrically with the first electrode; and the second wiring arrangement comprises a second extraction line for extracting the second voltage generated by the second power source, a second supply line connected to the second extraction line and extending substantially in parallel with respect to the target object, and a second distribution line connected to the second supply line and connected electrically with the second electrode.

6. The electric charge generating device according to claim 5, wherein the first extraction line and the second extraction line are arranged in confronting relation to each other, and the first supply line and the second supply line are arranged in confronting relation to each other.

7. The electric charge generating device according to claim 1, wherein the first electrode and the second electrode are arranged alternately along a longitudinal direction of the first power source and the second power source and/or along a longitudinal direction of the first wiring arrangement and the second wiring arrangement.

8. The electric charge generating device according to claim 1, wherein a plurality of the first electrodes and a plurality of the second electrodes are arranged on a virtual circle as viewed in plan.

9. The electric charge generating device according to claim 1, wherein the first electrode and the second electrode are needle electrodes having distal end portions which are exposed outside the housing.

10. The electric charge generating device according to claim 1, wherein the electric charge generating device is an ionizer that removes static charge and neutralizes a charged target object by releasing ions toward the target object.

* * * * *